United States Patent [19]

Iba et al.

[11] Patent Number: 4,817,484

[45] Date of Patent: Apr. 4, 1989

[54] ELECTRONIC STRINGED INSTRUMENT

[75] Inventors: Akio Iba, Tokorozawa; Shigeru Uchiyama, Sayama, both of Japan

[73] Assignee: Casio Computer Co., Ltd., Tokyo, Japan

[21] Appl. No.: 184,099

[22] Filed: Apr. 20, 1988

[30] Foreign Application Priority Data

Apr. 27, 1987 [JP] Japan ..... 62-101843
May 27, 1987 [JP] Japan ..... 62-134216
May 27, 1987 [JP] Japan ..... 62-134217

[51] Int. Cl.[4] ..... G10H 1/06; G10H 1/40; G10H 3/18

[52] U.S. Cl. ..... 84/1.16; 84/1.01; 84/1.03; 84/1.11; 84/DIG. 12; 84/DIG. 30

[58] Field of Search ..... 84/1.01, 1.03, 1.04–1.16, 84/1.19–1.27, DIG. 30, DIG. 12

[56] References Cited

U.S. PATENT DOCUMENTS 4,151,775 5/1979 Merriman ..... 84/1.01
4,235,141 11/1980 Eventoff .
4,263,520 4/1981 Kajihata et al. ..... 84/1.16 X
4,300,431 11/1981 DeRocco ..... 84/1.01
4,321,852 3/1982 Young, Jr. ..... 84/1.16
4,336,734 6/1982 Polson .
4,357,852 11/1982 Suenaga ..... 84/1.16
4,468,997 9/1984 Young, Jr. ..... 84/1.01
4,627,323 12/1986 Gold ..... 84/1.01
4,630,520 12/1986 Bonanno ..... 84/1.16
4,653,376 3/1987 Allured et al. ..... 84/1.16
4,657,114 4/1987 Shaw .
4,658,690 4/1987 Aitken et al. .
4,688,460 8/1987 McCoy .
4,748,887 6/1988 Marshall ..... 84/1.16 X
4,760,767 8/1988 Tsurubuchi ..... 84/1.16

FOREIGN PATENT DOCUMENTS 62-47698 3/1987 Japan .

*Primary Examiner*—Stanley J. Witkowski
*Attorney, Agent, or Firm*—Frishauf, Holtz, Goodman & Woodward

[57] ABSTRACT

An electronic stringed instrument includes a mode selecting section for selectively setting a normal play mode and at least one other selection mode. When picking of a string under a pitch designation operation status is performed after the normal play mode is selected by the mode selecting section, generation of a musical tone with the designated pitch can be started. When picking of a string also under the pitch designation operation status is performed after another selection mode is selected by the mode selecting section, a desired musical tone parameter such as a timbre corresponding to the designated pitch or a rhythm pattern can be easily set. The content of the set musical tone parameter can be confirmed by a sound.

11 Claims, 23 Drawing Sheets

| FRET NUMBER F \ STRING NUMBER N | 0 | 1 | 2 | 3 | 4 | 5 |
|---|---|---|---|---|---|---|
| 1 | PIANO SOUND | ORGAN SOUND | FLUTE SOUND | | | |
| ⋮ | ⋮ | ⋮ | ⋮ | ⋮ | ⋮ | ⋮ |
| 24 | BASS DRUM SOUND | HIGH-HAT SOUND | SNARE DRUM SOUND | HAND-CLAP SOUND | | |

ELECTRONIC STRINGED INSTRUMENT

BACKGROUND OF THE INVENTION

1. Field of the Invention

The present invention relates to an electronic stringed instrument, and, in particular, an electronic stringed instrument which can select a specific musical parameter, such as a timbre or a rhythm pattern by picking operation of strings.

2. Description of the Related Art

A known example of an electronic stringed instrument is a guitar synthesizer which is shaped like a guitar and has a synthesizer installed therein.

Guitar synthesizers can be classified into two types: the pickup type and the trigger type, on the basis of the system used for detecting a musical input entered by a player.

The pickup type synthesizer generally uses pickup sensors (typically, magnet type acoustic sensors) for independently detecting the vibrations of the individual strings. Since the output of each pickup sensor includes multifarious overtone or harmonic components in addition to a fundamental frequency component, this fundamental frequency component is therefore extracted from the sensor output by pitch extraction means. In addition, the timing at which string vibration starts and ends is detected by analyzing the level of the output of each pickup sensor.

When fundamental frequency data is extracted from the string vibration data and a condition to indicate the beginning of string vibration is met, a processor sends pitch data corresponding to the extracted fundamental frequency data to an internal or external sound source, so as to instruct generation of a musical tone of the associated string.

Then, when a condition for indicating the end of string vibration is satisfied, the processor instructs the sound source generating the musical tone to cease tone generation.

In contrast, the trigger type guitar synthesizer generally has a string trigger switch or a string trigger detector provided one for each string, for detecting the beginning of the string vibration, and has fret switches arranged in a fingerboard, for detecting the position operated on the fret with respect to each string. The fret switches can be an ON/OFF type arranged in a matrix on the fingerboard, a tablet coordination detection type, or a type in which conductive strings to be supplied with a minute current are stretched on the fingerboard and fret contacts are provided where each string is depressed.

When the beginning of a string vibration is detected through the string trigger switches or string trigger detectors, the processor reads out fret-operated position data (data attained through the fret switches) of a triggered string, prepares pitch data from the fret position data and the data of the string that has just started vibrating, and instructs an internal or external sound source to generate an associated tone. As a result, the sound source generates a tone having a specified pitch.

With either type of guitar synthesizer, a string-picking input entered by a player is utilized for no other purpose than to control the tone generated of the sound source and to control a short-duration parameter such as the pitch of the tone to be generated. However it is considered desirable that the player of the synthesizer be able to select other tone parameters (e.g., timbre) in addition to pitch. For instance, a guitar synthesizer having a communication function such as MIDI (Musical Instrument Digital Interface, which is the international standard for coupling musical instruments or mutual communication therebetween) generally has its communication line coupled to an external musical instrument or sound source module having a similar communicating function. With the use of such a guitar synthesizer, a timbre selection is likely to be executed while the synthesizer is being played. In such a case, the player or user should operate the timbre select switch provided on a panel of the external sound source module or the like to select the desired timbre of a tone to be generated. This necessitates that the user move to where a separated sound source module is located, every time the timbre change is needed. This is very troublesome to users. This may be solved by providing a timbre select switch on the main body of the guitar synthesizer; however, to ensure selection of a number of timbres (e.g., above 50 timbres), the same number of timbre select switches are required. Provision of many timbre select switches in the narrow guitar body not only increases the manufacturing cost of the synthesizer but also is difficult in consideration of the narrow space available in the guitar body.

The same problem would be raised in selecting other tone parameters, such as various rhythm patterns and various rhythms.

Recently, there has been proposed an electronic stringed instrument in which, with a specific function switch being depressed, for example, depressing the first fret of the first string changes the musical tone to a piano tone and depressing the second fret of the first string changes the musical tone to a string tone (as disclosed in the Japanese Patent Disclosure No. 62-47698). For instrument players, however, it is more natural and desirable to directly perform the picking of a string in order to select a musical tone with a specific timbre than to depress a specific fret position for the same purpose. If a timbre selection is performed by depressing a specific fret position, it is not easy for a player to sense what kind of timbre is actually selected.

SUMMARY OF THE INVENTION

The present invention has been developed to overcome the above conventional problems, and it is therefore an object of this invention to provide an electronic stringed instrument, which expands the limited function of conventional picking signal input devices so that the output of the same picking signal input device can also be used for other purposes, particularly, for selection of other tone parameters, and which prevents deterioration of the operability due to the functional expansion.

It is another object of this invention to provide an electronic stringed instrument which eliminates the need for providing a number of musical tone parameter select switches on a narrow instrument main body to select a desired musical tone parameter and needs a simple picking signal input operation to quickly and easily select the desired musical tone parameter.

It is a still another object of this invention to provide an electronic stringed instrument in which, in selecting a musical tone parameter, when a plurality of strings are erroneously triggered simultaneously by the picking operation or when the picking of strings is performed with an open-string operational status, it is possible to assuredly prevent an unintended musical tone parameter from being set.

Development and Operation of the Invention

The mode selecting section used in this invention can be designed so as to be able to select a desired mode not only from two modes but also from among three or more modes. This feature can be realized by the use of a mechanical rotary switch or a rotary switch (structurally, a two-position switch) which electronically advances the mode.

According to one arrangement, a timbre select mode can be set by the mode selecting section. In the timbre select mode, a picking signal, such as a pitch designation signal or a string vibration period signal, is given from the picking signal input device. Musical tone parameter setting means selects one of plural pieces of timbre data based on the received picking signal. This timbre data determines the timbre of a musical tone to be generated by an internal or external sound source. In a normal play mode, therefore, the musical tone with the selected timbre is generated.

In another arrangement, a rhythm select mode can be set by the mode selecting section. In this rhythm select mode, the picking signal is given from the picking signal input device. The musical tone parameter setting means selects one of plural pieces of rhythm pattern data based on the received picking signal. In an automatic rhythm play mode, therefore, a rhythm sound is automatically produced in accordance with the selected rhythm pattern data.

In a pickup type picking signal input device, the fundamental frequency data (as well as string number data indicating which string has been picked) of a vibrating string is given by pitch extraction means for each string, which is included in the picking signal input device. The musical tone parameter setting means determines or presumes the fret operation position of that string from the given fundamental frequency data. Then, the parameter setting means converts data of the fret operation position and the string number data into a musical tone parameter, for example, using a conversion table or through some computation.

In a trigger type picking signal input device, the fret operation input through a fret switch indicates which fret of which string has been operated. Further, the string trigger input from a string trigger switch o a string trigger detector indicates which string has started vibrating and when. Therefore, based on the fret operation position data and the string number data, the musical tone parameter setting means prepares an associated musical tone parameter at the timing of the string trigger input.

One preferable conversion logic is that, with the string number being expressed by a row number 1 and the fret operation position (fret number) being expressed by a column number c, a single (1, c) is converted into the value or number n of one musical parameter. In this case, provided that all the areas on the fiberboard are effective, different or various types of musical parameters whose quantity corresponds to the value of the fret quantity x the string quantity are available for selection. For instance, with regard to timbres, a specific timbre corresponding to the combination of a specific fret number and a specific string can be selected from a group of timbres equal in number to the fret quantity x the string quantity. Such one-to-one correspondence will not deteriorate the operability of the instrument.

Another conversion logic may also be used. For instance, it is possible to determine the value or number of a single musical parameter from a combination of two fret numbers F1 and F2 and two string numbers N1 and N2 (F1, N1 : F2, N2). In this case, the total number of selectable musical tone parameters is far greater than the one attained in the former case (about $M^C2$; M being the string quantity+ the fret quantity).

When new data is set as a musical tone parameter, a tone generation instructing section informs a user of the content of the set musical tone parameter by means of a sound only if the content indicates that the tone should be generated. For instance, when a new timbre is set, a musical tone with that new timbre is generated so as to inform the user of the content of the set musical tone parameter. When a new rhythm pattern is set, a sound source is driven with that rhythm patter to produce the associated rhythm sound to the outside, thus informing the user of the content of the set rhythm pattern.

DETAILED DESCRIPTION OF THE PREFERRED EMBODIMENTS

Preferred embodiments of this invention will be explained below in detail referring to the accompanying drawings.

[First Embodiment (FIGS. 1–9)]

Figure 1:
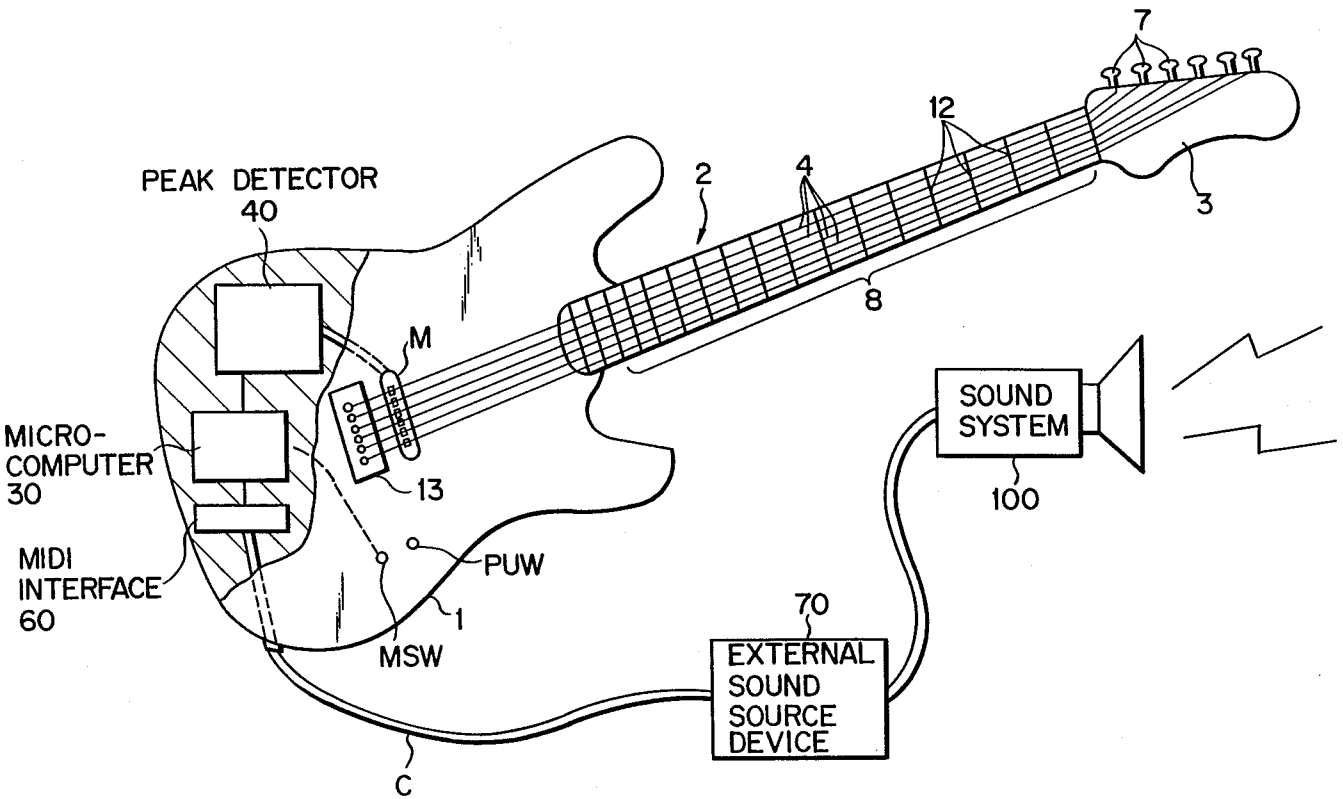
FIG. 1 is an exemplary perspective view of an electronic stringed instrument according to a first embodiment of this invention.

Instrument Main Body (FIG. 1)

The main body of an electronic stringed instrument according to the first embodiment is illustrated in FIG. 1. As illustrated, the stringed instrument main body comprises a body 1, a neck 2 and a head 3 and has an outline of a guitar. A plurality of strings 4 (six strings in this example) are stretched along the length of the main body. Specifically, each of strings 4, stretched on a fingerboard 8, has one end adjustably supported by a peg 7 and the other end secured to a bridge 13 provided on body 1. String-vibration pickup sensors MN for individually pick up the vibrations of the respective strings are provided in front of bridge 13. These pickup sensors M may be constituted by a piezoelectric or magnet type microphone. Sensor signals from pickup sensors M are sent to a peak detector (sensor interface) 40 (which will be described later) where extract of a timing signal at a peak and A/D conversion of the sensor signals are performed. When picking of a string on fingerboard 8 is performed with the string depressed at an arbitrary fret 12 by a finger or the like, the associated sensor M generates a sensor signal. Fundamental frequency data of the signal represents a frequency concerned with the string length between bridge 13 and the position of the depressed fret, the material and the tension of the string, etc. The sensor signal includes various harmonic components mixed in the reference frequency data.

A mode switch MSW is provided on body 1 according to this invention. According to this embodiment, mode switch MSW is designed to selectively set a normal play mode and a timbre select mode (which will be described later in detail). For diagrammatic simplicity, other panel switches are not illustrated.

The electronic stringed instrument as shown in FIG. 1 is a MIDI instrument which can be coupled to an external MIDI instrument, etc. In the illustrated example, the instrument is coupled to an external sound source 70 through a cable C for carrying a serial asynchronous MIDI signal, and a musical tone signal generated by this sound source 70 is put through a sound system 100 for tone generation.

Figure 2:
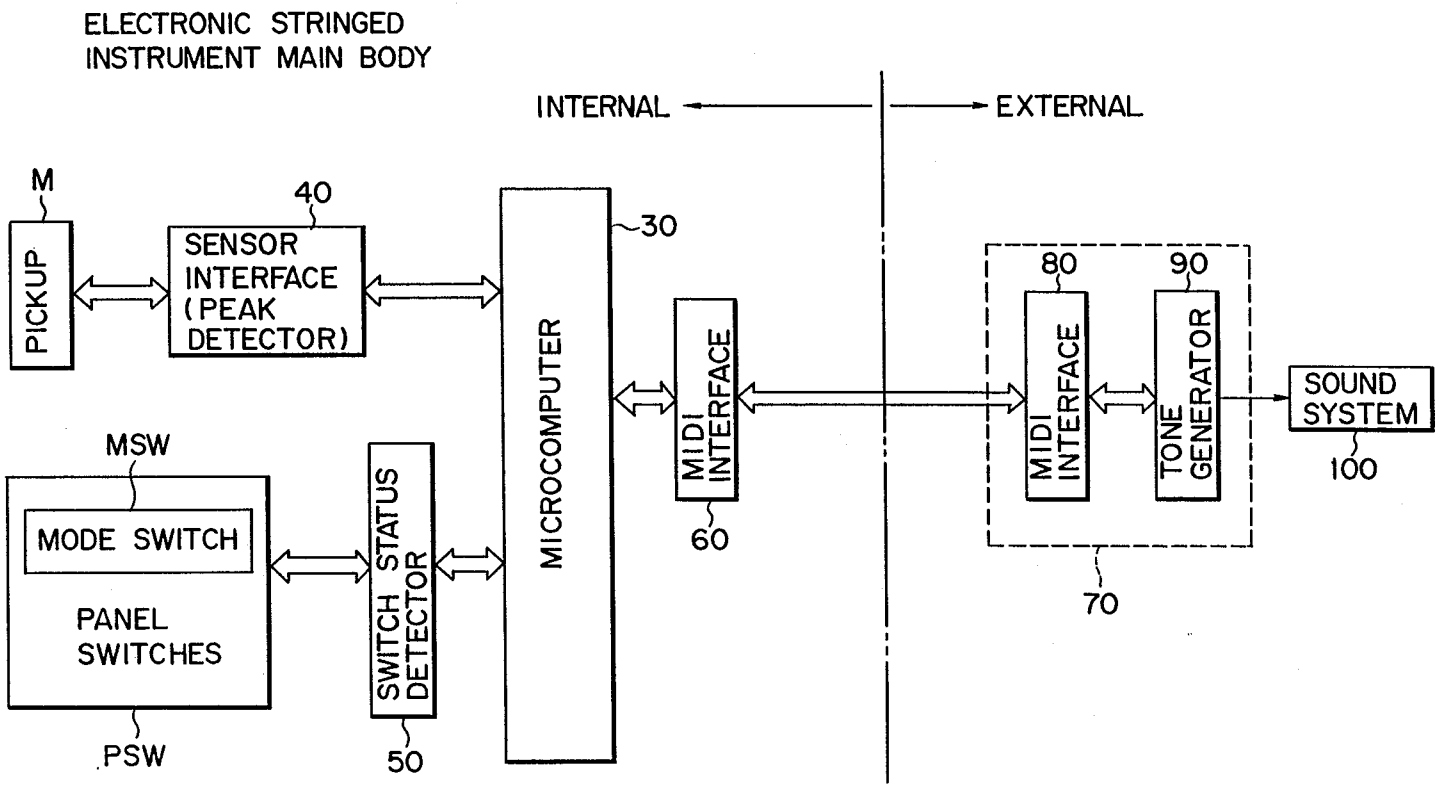
FIG. 2 is a diagram illustrating the overall structure of the first embodiment in use.

Overall Circuit Structure (FIG. 2)

FIG. 2 illustrates the overall circuit structure of the electronic stringed instrument according to the first embodiment. On the left side of the two-dot chain line is the main body of the electronic stringed instrument and on the right side of the line is an external section of the main body. The general control of the electronic stringed instrument is executed by a microcomputer 30. A switch status detector 50 detects the status of each of panel switches PSW on the instrument main body including the aforementioned mode switch MSW, and is constituted by a known circuit. A MIDI interface 60 is a known circuit constituted by a UART (Universal Asynchronous Receiver & Transmitter). MIDI interface 60 has a transmission section for transmitting data from microcomputer 30 to an external unit in the format which meets the MIDI standard. The transmitted signal is received by a reception section of a MIDI interface 80 of external sound source 70. Tone control data associated with the received signal is sent through MIDI interface 80 to a tone generator 90, which in turn executes preparation of a musical tone, etc.

Peak detector 40 which processes the sensor signals from pickup sensors M will now be explained in detail.

Figure 3:
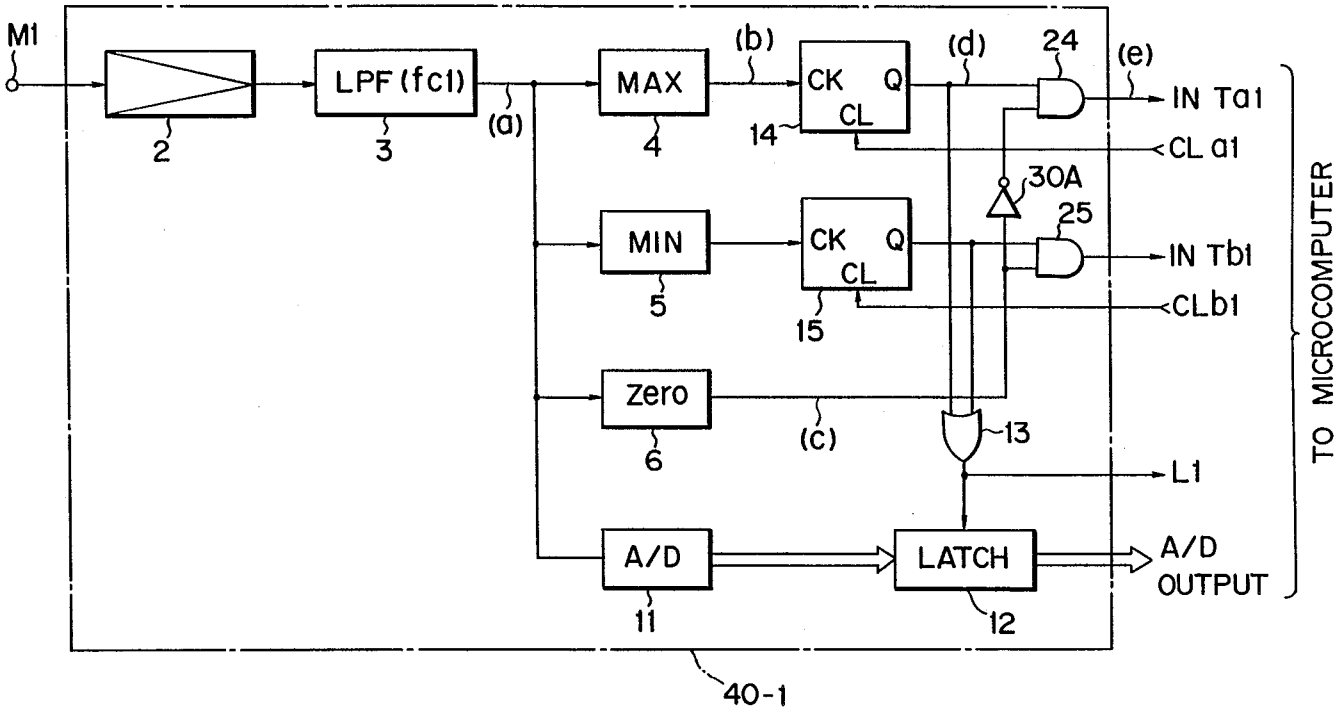
FIG. 3 is a circuit diagram of a peak detector shown in FIG. 2.

Peak Detector (FIG. 3)

FIG. 3 illustrates a peak detector (denoted by 40-1) for one channel. M1 is a pickup sensor output terminal of, for example, the first string. $INT_{a1}$, $CL_{a1}$, $INT_{b1}$, $CL_{b1}$ and $L_1$ are signals transmitted between peak detector 40-1 and microcomputer 30. $INT_{a1}$ is a signal which indicates the point where the pickup sensor signal representing the string vibration reaches the positive peak (MAX) and is given to microcomputer 30 as an interrupt signal. $CL_{a1}$ is a reset signal given to peak detector 40-1 from microcomputer 30. $INT_{b1}$ is a signal which indicates the point where the string vibration signal from pickup sensor output terminal M1 reaches the negative peak (MIN) and is given to microcomputer 30 as an interrupt signal. $CL_{b1}$ is a reset signal given to peak detector 40-1 from microcomputer 30. $L_1$ is a latch signal which indicates that the positive or negative peak value of the string vibration signal from pickup sensor output terminal M1 has been subjected to A/D conversion and held, and is sent to microcomputer 30 from peak detector 40-1.

Figures 4A, 4B, 4C, 4D, 4E:
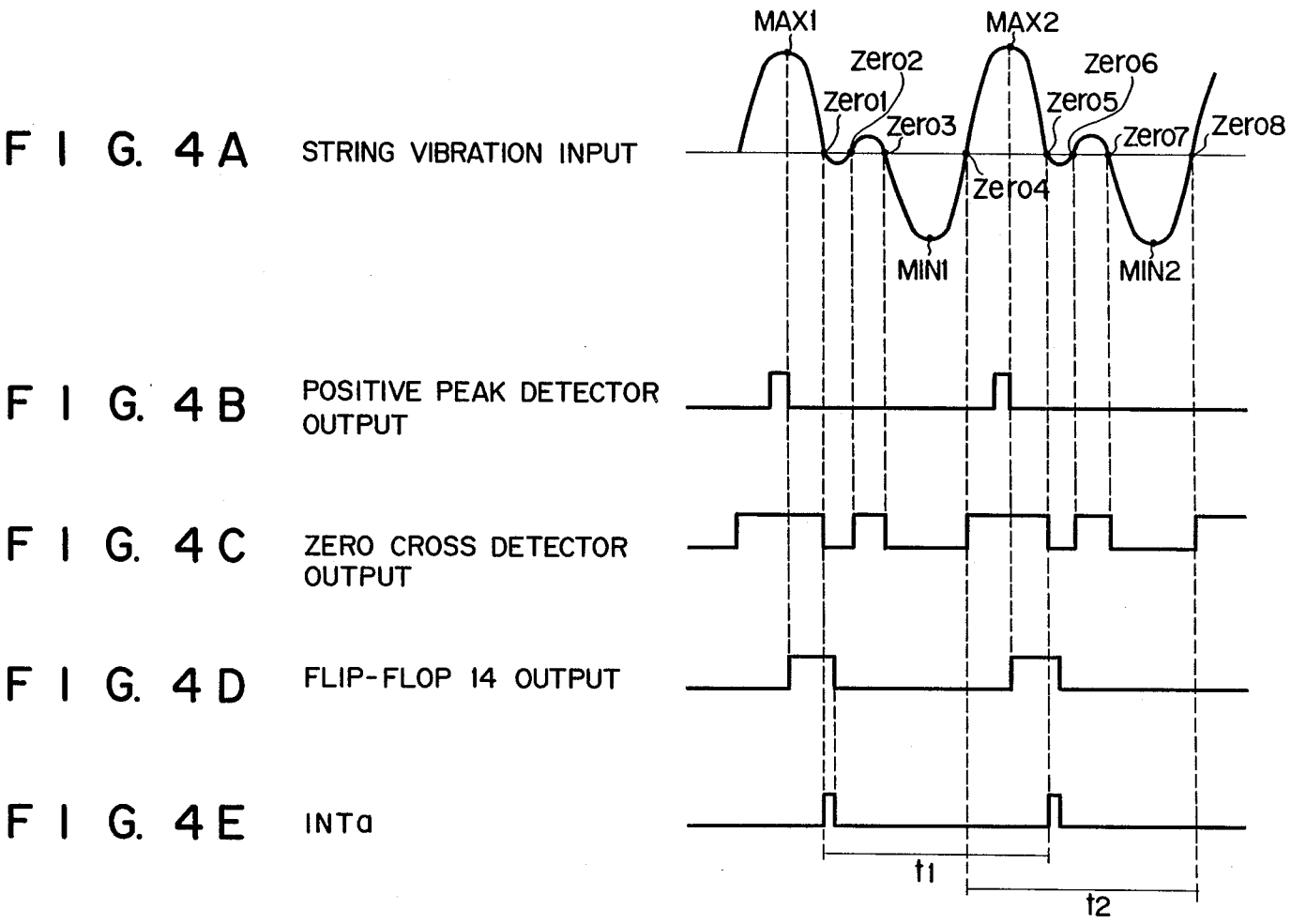
FIGS. 4A to 4E are timing charts of signals at individual components of the peak detector.

The internal structure of pickup sensor 40-1 is as illustrated in FIG. 3; the sensor signal from pickup sensor output terminal M1 is amplified in an amplifier 2 and is supplied to a low-pass filter 3 where a undesirable harmonic component of the signal is removed (the cut-off frequency fcl being about four times the frequency of an open string). FIG. 4A exemplifies the output a of low-pass filter 3. As should be obvious from the figure, the waveform of the string vibration signal from pickup sensor output terminal M1 has an overtone component added to the reference frequency data. The filtered signal a is supplied to a positive peak detector 4 (MAX), a negative peak detector 5 (MIN), a zero cross detector 6 (Zero) and an A/D converter 11.

Positive peak detector 4 detects the point of the positive peak of the string vibration signal while negative peak detector 5 detects the point of the negative peak of that signal. FIG. 4B exemplifies the output signal of positive peak detector 4.

Zero cross detector 6 detects the zero cross of the string vibration signal and inverts its output. For instance, this detector 6 has a high level output while the string vibration signal is in a positive duration and has a low level output while it is in a negative duration. FIG. 4C exemplifies the output of zero cross detector 6.

A pulse signal b from positive peak detector 4 sets a flip-flop 14 and a pulse signal from negative peak detector 5 sets a flip-flop 5. FIG. 4D exemplifies the output of flip-flop 14. At the time the output of zero cross detector 6 becomes a low level (i.e., at the time the string vibration signal zero-crosses from the positive to the negative), an AND gate 24, which receives the output of flip-flop 14 and an inverted output of zero cross detector 6 through an inverter 30A, sends the set output of flip-flop 14, which indicates the occurrence of the positive peak, to microcomputer 30 as interrupt signal $INT_{a1}$. Therefore, interrupt signal $INT_{a1}$ being active means that the zero cross of the string vibration signal from the positive level to the negative level has occurred after this signal reached the positive peak. FIG. 4E illustrates an example of interrupt signal $INT_{a1}$. Similarly, an AND gate 25 renders its output or an interrupt signal active and sends it to microcomputer 30 when the zero cross of the string vibration signal from the negative level to the positive level occurs after this signal has reached its negative peak (after flip-flop 15 is set).

Upon reception of interrupt signal $INT_{a1}$ or $INT_{b1}$, microcomputer 30 resets the associated flip-flop 14 or 15 using signal $CL_{a1}$ or $CL_{a2}$. In response to signal $L_1$, microcomputer 30 reads the content of a latch 12 or the digital value of the positive or negative peak value of the string vibration signal.

The input and output signals of pickup sensor 40-1 will further be discussed below. The duration of output signal $INT_{a1}$ being active corresponds to the time from the point when the string vibration signal is at its positive peak to the point when this signal is at the next positive peak. More specifically, signal $INT_{a1}$ becomes active at the time the string vibration signal, after reaching its positive peak, zero-crosses to the negative level and becomes active again at the time the string vibration signal, after reaching the positive peak again, zero-crosses to the negative level (see FIG. 4A). The duration of output signal $INT_{b1}$ being active ranges from the point when the string vibration signal, after reaching the negative peak, zero-crosses to the positive level to the point when the string vibration signal, after reaching the negative peak again, zero-crosses to the positive level. The durations of generation of such output signals $INT_{a1}$ and $INT_{b1}$ are the basis of the fundamental frequency data of the string vibration. Regrettably, due to the influence of the overtone component included in the string vibration signal, these durations may not be the fundamental period of the string vibration. This influence of the overtone component is considered to some degree in designing pickup sensor 40-1 so as to reduce the influence (for instance, the function of detecting the occurrence of a zero cross in the opposite direction after the string vibration signal reaches its each peak). The removal of the remaining influence should be executed by microcomputer 30. That is, a pre-process for pitch extraction is executed by pickup sensor 40-1 and the final pitch extraction (period computation) is executed by microcomputer 30.

Pitch Extraction by Microcomputer (FIGS. 4A–4E, 5A and 5B)

In this embodiment, for the pitch extraction, microcomputer 30 employs the following basic conditions to accept the aforementioned signal generating duration (e.g., the generating duration of $INT_{a1}$ or $INT_{b1}$) as the fundamental period:

(i) Occurrence of a zero cross to the negative (positive) level after the string vibration signal reaches its positive (negative) peak, (ii) Occurrence of a zero cross to the positive (negative) level after the string vibration signal reaches its negative (positive) peak after occurrence of the above zero cross (i), and (iii) Occurrence of a zero cross to the negative (positive) level after the string vibration signal reaches its positive (negative) peak after occurrence of the above zero cross (ii).

Therefore, for instance, if $INT_{a1}$ and $INT_{b1}$ are alternately generated (i.e., if the positive and negative peaks are alternately generated), the $INT_{a1}$-generating duration $t_1$ is evaluated as the fundamental period, so is the $INT_{b1}$-generating duration $t_2$ (see FIG. 4E). However, if, after generation of signal $INT_{a1}$, the same signal $INT_{a1}$, not $INT_{b1}$, is generated again, the $INT_{a1}$-generating duration is not evaluated as the reference period for the string vibration.

Figure 5A:
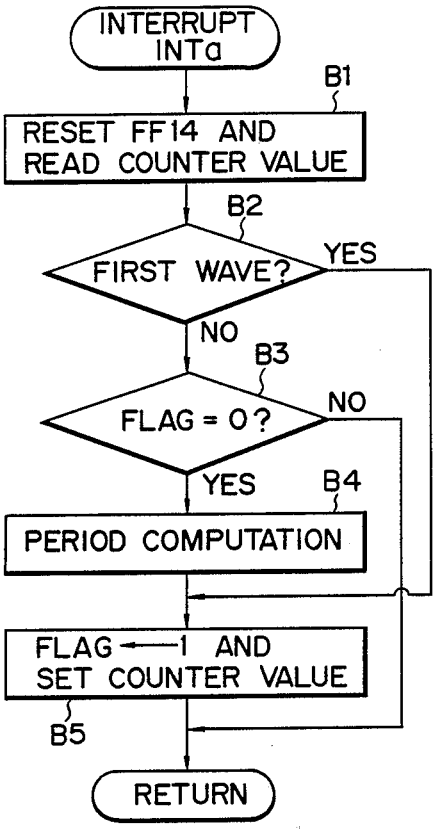
FIG. 5A is a flowchart illustrating an interrupt process executed by a microcomputer for pitch extraction at the time a zero cross from a positive peak is detected.
Figure 5B:
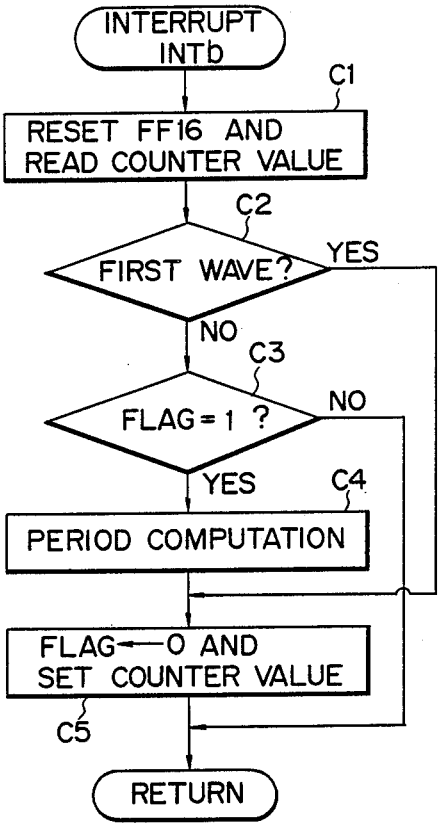
FIG. 5B is a flowchart illustrating an interrupt process executed by the microcomputer for pitch extraction at the time a zero cross from a negative peak is detected.

FIGS. 5A and 5B illustrate examples of the sequence for checking the above conditions. In the figures, $INT_a$ represents a signal generated upon occurrence of a zero cross after the positive peak of the vibration signal for each string is detected by the associated one of peak detectors 40-1 to 40-6. Similarly, $INT_b$ represents a signal generated upon occurrence of a zero cross after the negative peak of the vibration signal for each string is detected by the associated peak detector.

The flowcharts shown in FIGS. 5A and 5B are both executed as an interrupt process in microcomputer 30. Paying attention to the content of a flag, the flag is set to "1" at the first wave in the flow for the positive peak (FIG. 5A) and is reset to "0" at the first wave in the flow for the negative peak (FIG. 5B). The condition for executing the period computation in the flow for the positive peak is that the peak is not at the first wave (step B2) and the flag is set to "0," i.e., the negative peak has already been at the first wave (step B3). In the period computation (step B4), a count value read and set in a counter at the first wave is subtracted from a present count value in order to provide the length of the period. The computation result is written in a present period data memory and a period confirmation flag is set. The previous content of the present period data memory is transferred to a previous period data memory. The counter is free-running in microcomputer 30. The above explanation with the self-explanatory flows B1–B5 and C1–C5 shown in FIGS. 5A and 5B is considered to be sufficient for the interrupt operation so that a further explanation of the operation will be omitted.

More severe conditions than the above can of course be set for pitch extraction.

Figures 6, 9:
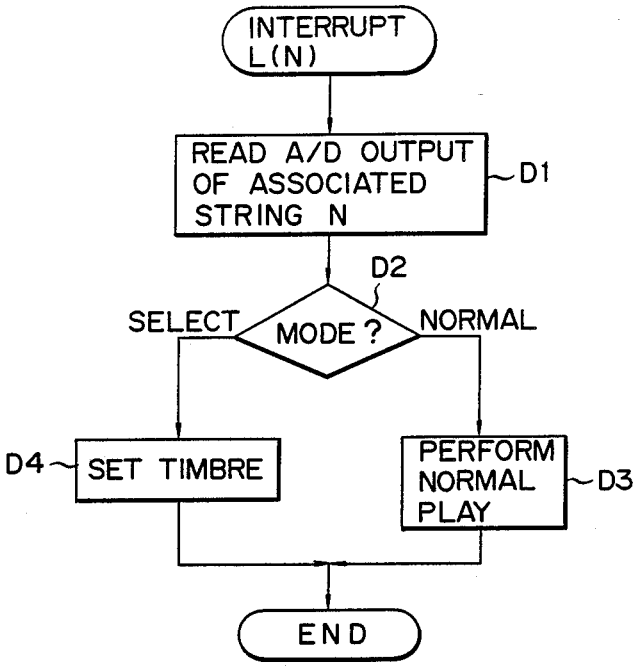
FIG. 6 is a flowchart for a mode-originated process executed by the microcomputer.
FIG. 9 is a diagram illustrating a logic for determining a timbre from a string number and a fret number.

Mode-Originated Process (FIG. 6)

As explained above, the electronic stringed instrument according to this embodiment has mode select switch MSW provided on its main body as one of panel switches (see FIG. 1). This mode select switch MSW is of a toggle type, for example, which, when depressed each time, cyclically switches the mode of the electronic stringed instrument from a normal play mode to a timbre setting mode and back to the normal play mode. More specifically, in a panel status detection process, when informed of a change in the status of panel switches from switch status detector 50, microcomputer 30 checks which panel switch has changed its status, and if the status of mode select switch MSW is changed to an ON status, the content of a mode flag is rewritten to set a newly-instructed mode.

The content of the set mode flag is referred to through MIDI interface 60 (FIG. 2) in a process executed for external sound source 70. That is, the result of the above pitch extraction is processed distinguishably for each mode. Particularly, in according to this embodiment, microcomputer 30 responds to an interrupt signal L (N) (which indicates the end of A/D conversion of the peak value of the string vibration signal from the N-th string) and executes the flow exemplified in FIG. 6.

First, in step D1, microcomputer 30 reads the content of latch 12 (FIG. 3) of an associated peak detector 40. That is, microcomputer 30 reads the peak value of a vibration signal of the associated string. In the subsequent step D2, microcomputer 30 checks the value of the mode flag so as to discriminate whether the mode is the normal play mode or the timbre select mode. If it is the normal play mode, the flow advances to step D3 for execution of the normal play process, and if it is the timbre select mode, the flow advances to step D4 for execution of the timbre setting process.

Figure 7:
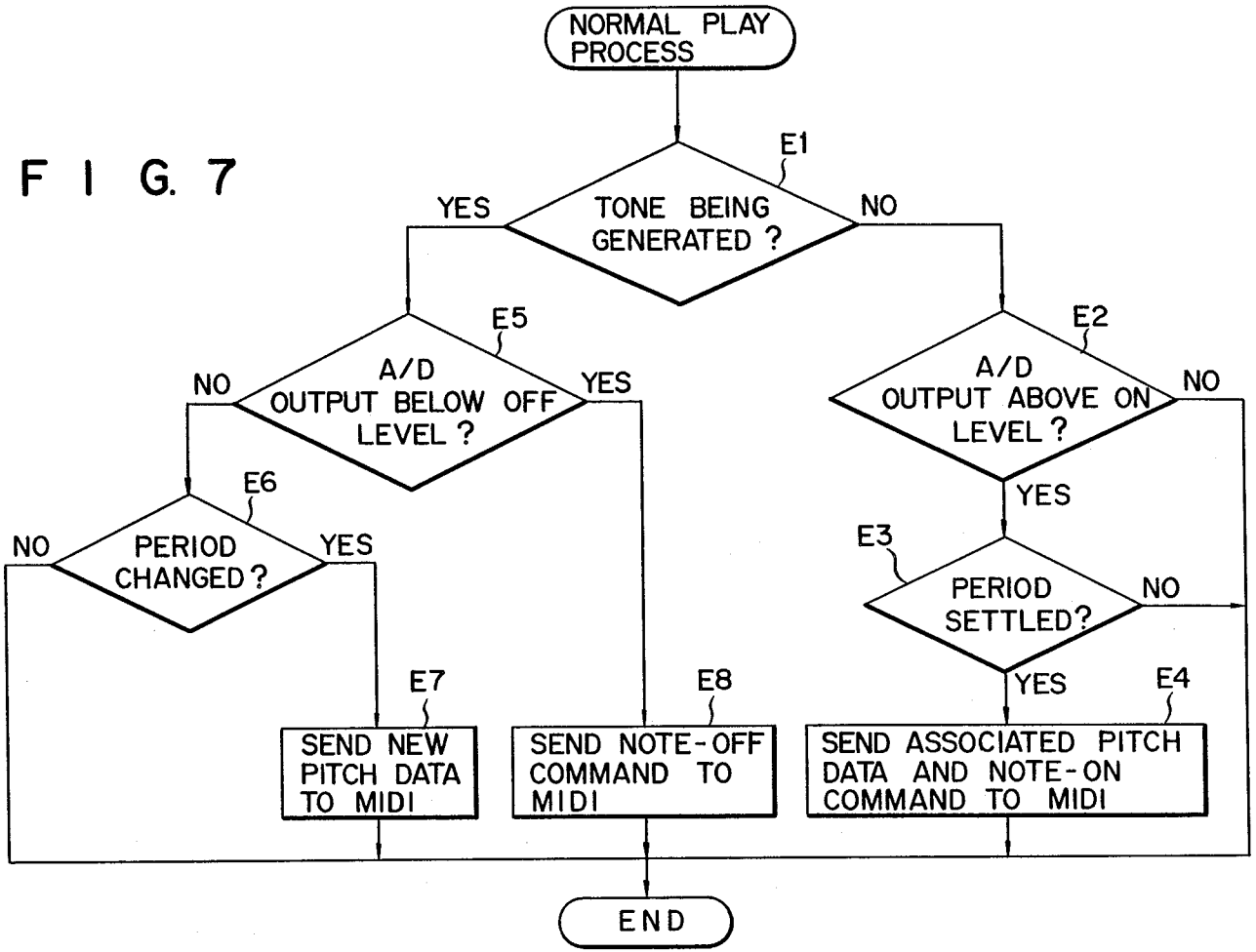
FIG. 7 is a detailed flowchart of a normal play process shown in FIG. 6.

Normal Play Process (FIG. 7)

FIG. 7 illustrates a detailed example of the normal play process.

In the first step E1, it is discriminated whether or not a string of interest is producing a musical tone. (This discrimination may be made by referring to a tone-on/tone-off flag.) If the string is not producing any tone, it is discriminated in the next step E2 whether or not the present A/D output has reached a predetermined note-on level. If the decision in E2 is negative, nothing will be done, but if it is affirmative, the flow advances to step E3 where it is discriminated whether or not the vibration period of the string is settled. If the period has not been settled yet, nothing will be done, but if it has already been settled, the flow advances to step E4 where the period data is read out, data such as a note number (pitch data) satisfying the MIDI standard is prepared, and this note number and a note-on command are sent to MIDI interface 60. In addition, the tone-on/tone-off flag of that string is set to the tone-on value. As a result, the note number and the note-on signal are sent to external sound source 70 from which the associated musical tone is produced.

Once the tone-on/tone-off flag is set to a tone-on value, in the subsequent passes, it is discriminated in step E1 that tone generation is in process. In this case, the flow advances to step E5 where it is discriminated whether or not the A/D output is below a predetermined note-off level. If the A/D output is not yet below the note-off level, the flow advances to step E6 where it is checked if the period has been changed. (This discrimination is made by comparing the present period data with the previous period data.) If the period has not been changed, nothing will be done, but if it is changed, the flow advances to step E7 where a note number (pitch data) corresponding to the present period data is prepared and is sent to MIDI interface 60. As a result, external sound source 70 prepares a musical tone whose pitch changes with a change in the period of the string vibration.

If it i discriminated in step E5 that the A/D output is below the note-off level, the flow advances to step E8 where a note-off command is sent to MIDI interface 60 and the tone-on/tone-off flag of the string involved in this process is set to a tone-off value. Consequently, external sound source 70 attenuates the musical tone of that string to stop the tone generation.

Figure 8:
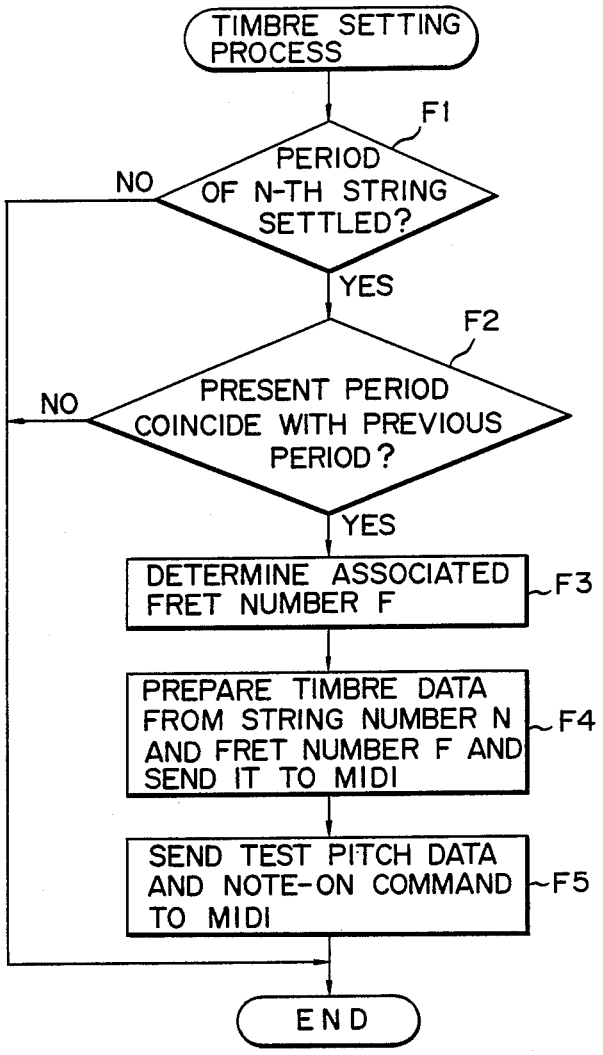
FIG. 8 is a detailed flowchart of a timbre setting process shown in FIG. 6.

Timbre Setting Process (FIGS. 8 and 9)

FIG. 8 gives a detailed illustration of the timbre setting process. First, in step Fl, it is checked if the vibration period of the associated string is settled. If the period is settled, the flow advances to step F2 where it is discriminated whether or not the present period coincides with the previous one. (This discrimination is made by comparing the content of the present period data memory with the content of the previous period data memory.) If a coincidence occurs in step F2, the flow advances to step F3 where an associated fret number F is determined. In the next step F4, timbre data is prepared from the number N of the string in check and the determined fret number F and is sent to MIDI interface 60. When the fret number F and string number N are determined as illustrated in FIG. 9, a specific timbre will be determined. For instance, when the string number N is "0" (first string) and the fret number F is "1" (first fret), the timbre for piano sounds are determined. This process may be realized using a conversion table (e.g., a memory in which a timbre number is written at a location specified by an address having higher bits set for the string number N and lower bits set for the fret number F) or through computation. As a result of the process performed in step F4, a timbre of a musical tone to be generated is newly set in external sound source 70. In the subsequent step F5, test pitch data (e.g., a note number of a pitch C4) and a note-on command are sent to MIDI interface 60. Consequently, external sound source 70 produces a musical tone with the timbre set in the previous step F4 at the pitch C4.

As should be obvious from the above explanation, if a player desires a different timbre, the player operates mode select switch MSW on the instrument main body to set the timbre select mode. In this state, the player depresses the desired fret 12 of the desired string and performs the picking of that string. Accordingly, the associated timbre is determined by the string 4 and the fret 12 and the player is informed of this fact from external sound source 70 through sound system 100. This permits the player to switch the timbre to the desired one without actually going to external sound source 70, thus providing a high operability. Further, no extra timbre select switches are needed, thus reducing the cost of the required components.

[Second Embodiment (FIGS. 10–21)]

The second embodiment will be explained below.

The second embodiment differs mainly from the first embodiment in that the former is directed to a trigger type guitar synthesizer whereas the latter is directed to a pickup extraction type guitar synthesizer. In other words, these two embodiments differ from each other in the structure of the picking signal input device and the associated sections and are almost the same in the other respects. Accordingly, the same reference numerals are used to specify the identical or corresponding elements and their explanation will be omitted.

Figure 10:
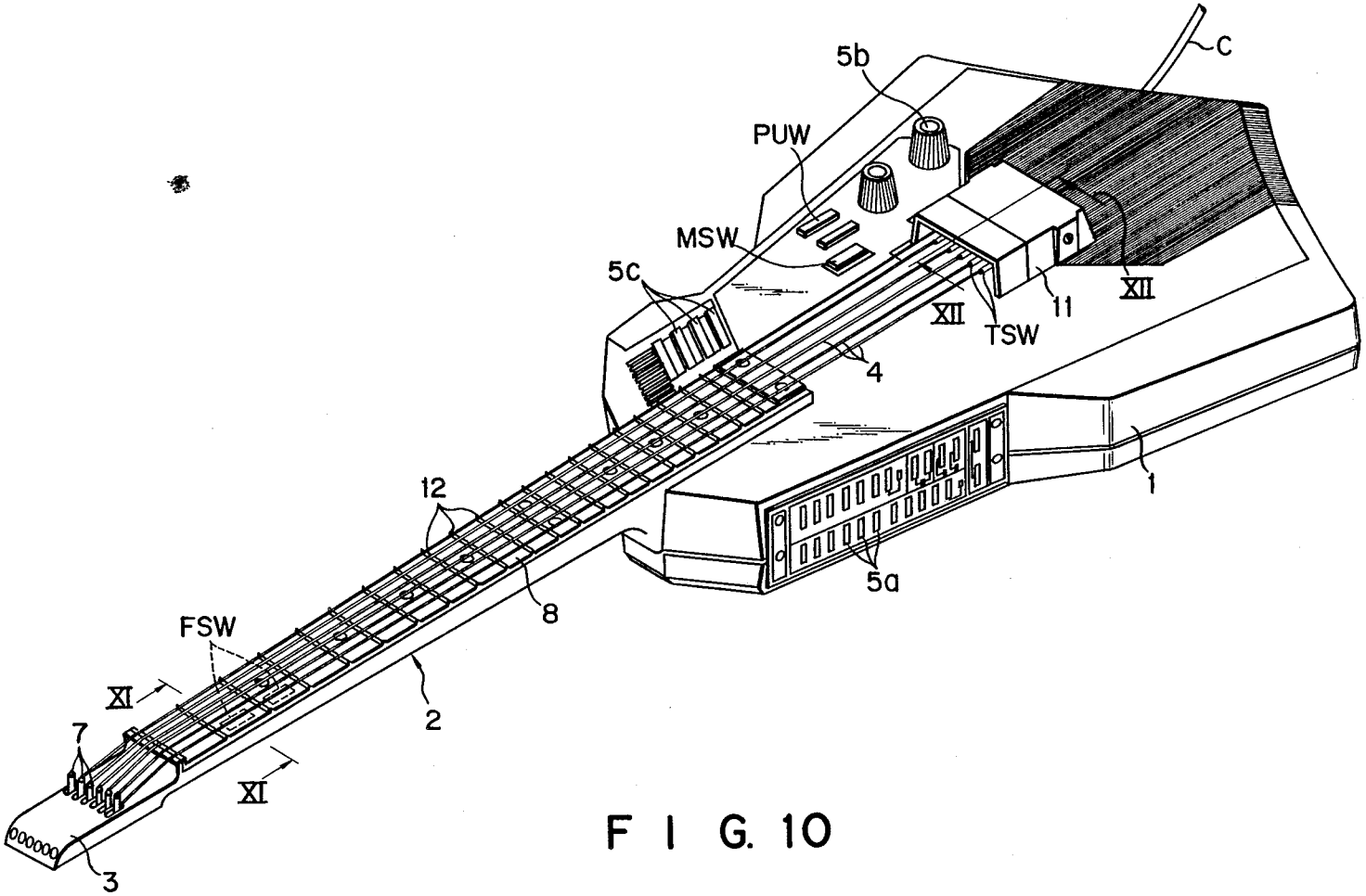
FIG. 10 is a perspective view of an electronic stringed instrument according to a second embodiment.

Instrument Main Body (FIG. 10)

FIG. 10 shows the main body of an electronic stringed instrument according to the second embodiment. Like the first embodiment, the instrument main body of this embodiment has the outline of a guitar and has a body 1, a neck 2 and a head 3, with a plurality of strings 4. As illustrated, panel switches PSW are also provided on body 1 and include a mode select switch MSW and other panel switches 5*a*, 5*b* and 5*c*. The second embodiment differs from the first one in that a number of fret switches FSW are provided in a matrix form at positions corresponding to the individual strings 4 on a fingerboard 8 and string trigger switches TSW are provided within a case 11 located at one end of the strings in order to detect the beginning of vibration of the respective strings 4. The array of fret switches FSW is for detecting the fret operation positions for the individual strings 4.

In this respect, a detailed description of fret switches FSW and string trigger switches TSW will be given below.

Figure 11:
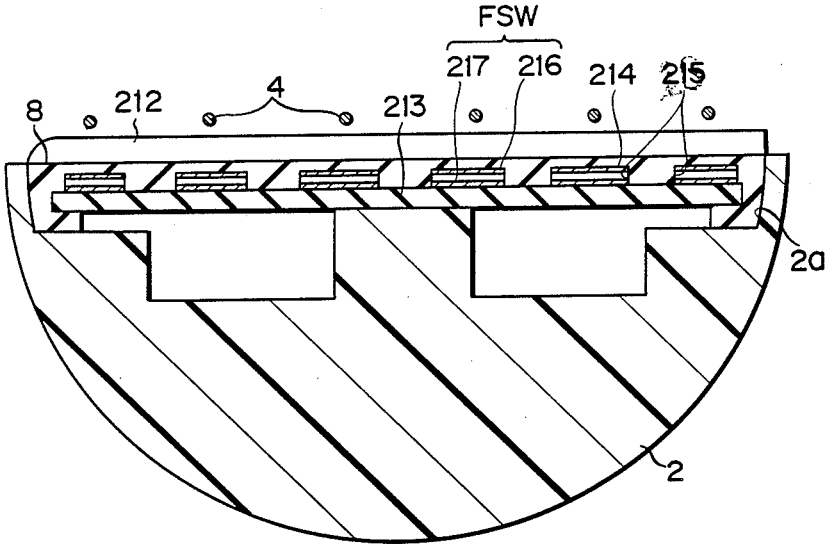
FIG. 11 is a cross-sectional view taken along the line XI—XI in FIG. 10, illustrating a fret switch.

Fret Switches (FIG. 11)

FIG. 11 exemplifies the structure of fret switches FSW. As illustrated, a printed board 213 and a rubber sheet 214 are fitted and secured in a recessed section 2*a* formed in the top of neck 2. Rubber sheet 214 is laminated on printed board 213 and has its both ends bent in a U shape to accommodate the associated end of printed board 213. Six rows of contact recesses 215 are formed along the length of neck 2, at locations corresponding to the individual strings 4 at the bottom of rubber sheet 214, which is adhered to the top of printed board 213. A pattern of electrodes 216 serving as movable contacts is formed on the bottom surfaces of recesses 215, and a pattern of electrodes 217 serving as stationary contacts is formed on printed board 213, the electrodes 217 facing the associated electrodes 216. Each electrode 217 and its associated electrode 216 constitute a fret switch FSW for designating a predetermined pitch. When strings 4 on fingerboard 8 are depressed, hence depressing rubber sheet 214, electrodes 216 are brought into an electric contact with electrodes 217 so that fret switches FSW are turned on.

Figure 12:
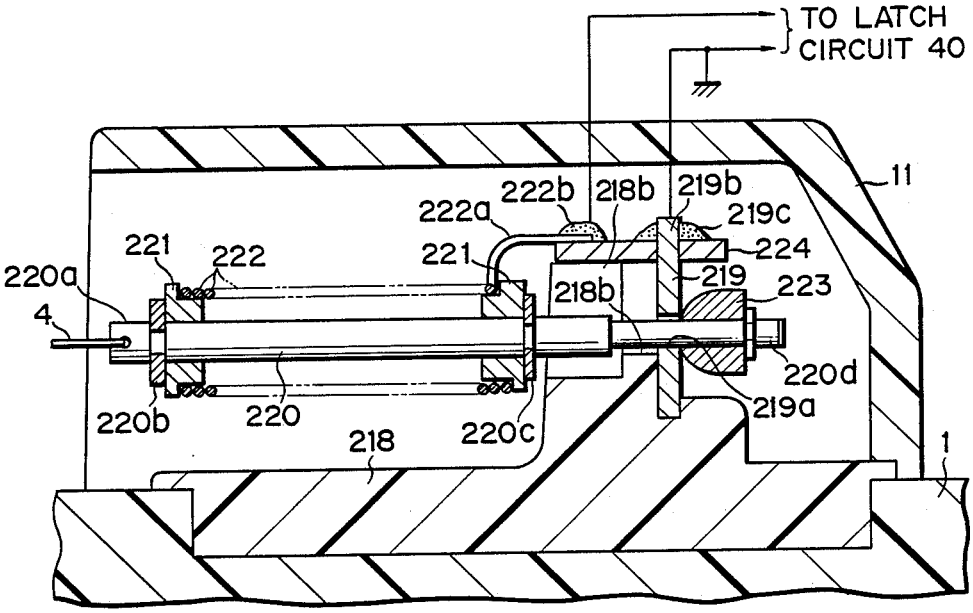
FIG. 12 is a cross-sectional view taken along the line XII—XII in FIG. 10, illustrating a string trigger switch.

String Trigger Switches (FIG. 12)

FIG. 12 exemplifies the structure of string trigger switches TSW. As mentioned earlier, string trigger switches TSW are turned on or off by strings 4 on body 1. As illustrated in FIG. 12, on body 1 is disposed a switch mounting table 218, which has a projecting section and a support section 218*a* provided on the upper portion of the projecting section. In support section 218*a* are grooves 218*b* formed whose number corresponds to the number of strings 4. A metal contact plate 21 is attached to the rear edge portion of support section 218*a*, and has through holes 219*a* formed therein at positions corresponding to the individual strings 4. Conductive members 220 integrally coupled to the respective strings 4 are fitted in the associated through holes 219*a*. Each conductive member 220 is a circular metal rod with a predetermined length and has an engage hole 220*a* at its distal end where the associated string 4 is engaged. Each conductive member 220 further has a first stop ring 220*b* provided at the rear portion of the engage hole 220*a* and a second stop ring 220*c* separated by a predetermined distance from the former ring 220*b*. The first and second stop rings 220*b* and 220*c* are provided to prevent a pair of insulative members 221, provided on the associated conductive member 220 with a predetermined interval therebetween, from moving in the lengthwise direction of conductive member 220. Both insulative members 221 and 221 have stepped portions facing each other, and a spring coil 222 serving as a flexible conductive member is bridged between the two stepped portions. Each conductive member 220 has a support shaft 220*d* formed at that portion thereof which extends from the back of second stop ring 220*c* and is narrower than the remaining portion. The end portion of support shaft 220*d* is fitted in the associated groove 218*b* of support section 218*a* and the associated through hole 219*a* of contact plate 219, and is engaged with a stopper 223 having a semi-sphere distal end portion, in a slidable manner around the through hole 219*a*. That is, each conductive member 220 has its rear end slidably engaged with support shaft 220*d* and has the other, free end supported to be stretched by its associated string 4. Projections 219*b*, formed at the top portion of contact plate 219 in correspondence with through holes 219*a*, are securely fitted in predetermined locations of a printed board 224 provided on support section 218*a* and are coupled to a wiring pattern formed on printed board 224, by means of solder 219*c*. A lead wire 222*a* extending from one end of each coil spring 222 coupled through insulative members 221 to conductive member 220 is also coupled to another wiring pattern formed on printed board 224, by means of solder 222*b*.

The illustrated trigger switches TSW, described above, each have conductive member 220 as the first contact and coil spring 222 as the second contact. In the normal state, a space corresponding to the thickness of insulative member 221 is kept between coil spring 222 and conductive member 220 for insulation therebetween. When a vibration of a certain degree or more is caused by operating string 4, however, coil spring 222 vibrates due to the vibration. As a result, the space between conductive member 220 and coil spring 222 varies with time and the member 220 and spring 222 repeat alternate contact and non-contact states. In other words, trigger switch TSW is alternately turned on and off. As will be described later, according to this embodiment, the status change of this trigger switch TSW toward the first ON state (i.e., triggering of string 4) can be assuredly detected.

Figure 13:
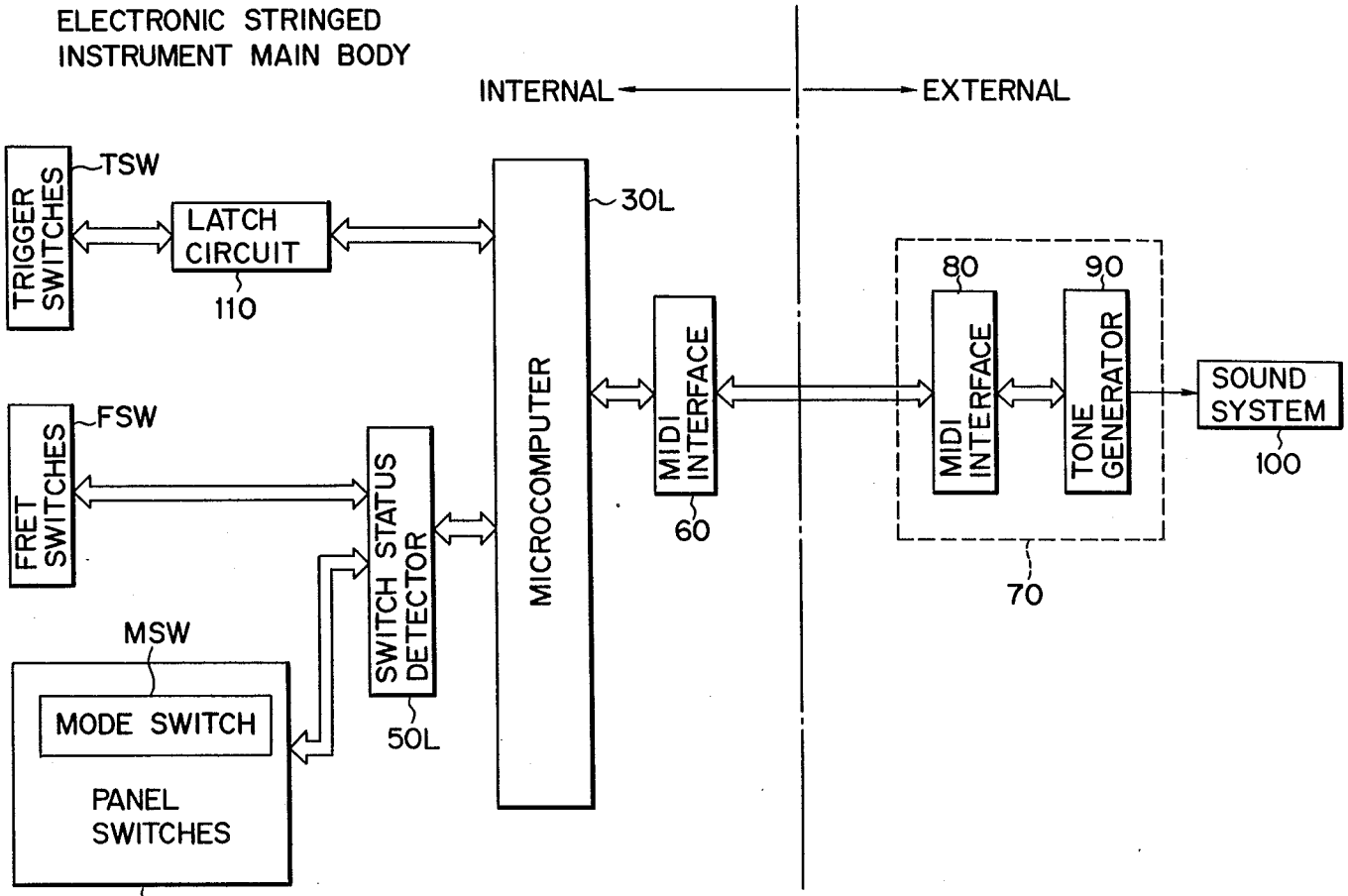
FIG. 13 is a diagram illustrating the overall structure of the second embodiment in use.
Figure 14:
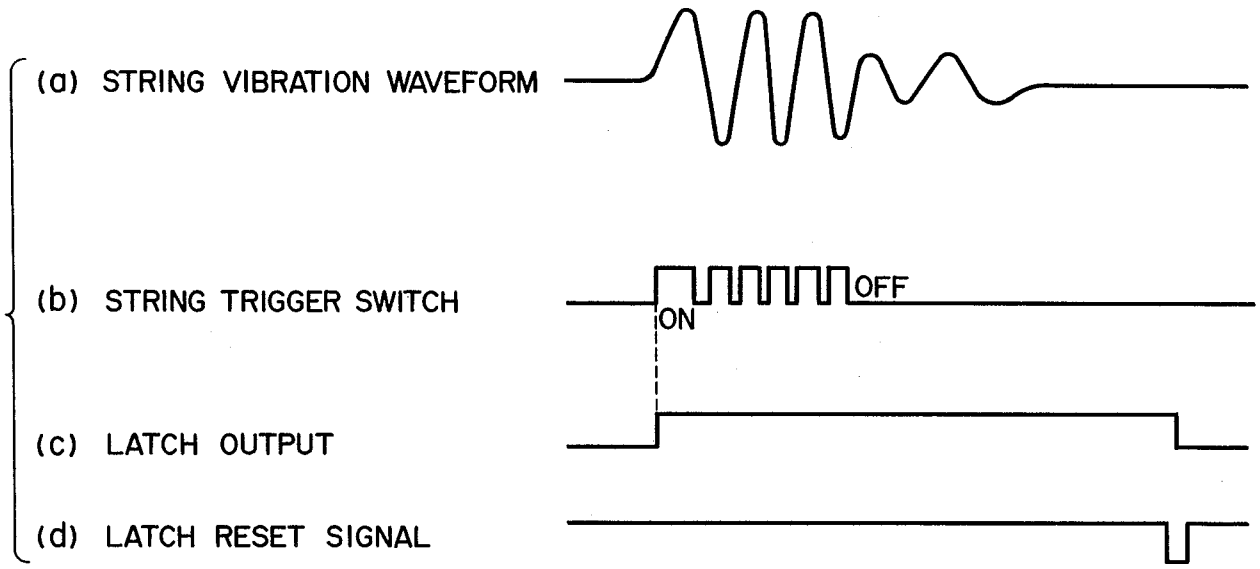
FIG. 14 is a timing chart for explaining the operation of peripheral units of a latch circuit shown in FIG. 13.

Overall Circuit Structure (FIG. 13)

FIG. 13 illustrates the overall circuit structure of the electronic stringed instrument according to this embodiment, with external sound source 70 coupled thereto, as per the first embodiment. According to this embodiment, trigger switches TSW and fret switches FSW are used as the picking signal input device. A latch circuit 110 is provided as an interface between trigger switches TSW and a microcomputer 30L, and a switch status detector 50L serves as an interface between fret switches FSW and microcomputer 30L as well as an interface between panel switches PSW and the microcomputer, i.e., the switch status detector has two separate functions.

Latch circuit 110 comprises the same number of latch elements (flip-flops) as the number of the strings, and these latch elements are respectively coupled to string trigger switches TSW provided for the respective strings in such a manner that when string trigger switches TSW are turned on, the associated latch elements are set. In a string trigger detection process which will be described later, microcomputer 30L samples the content of each latch element and compares it with the previous sampled value to detect which string has started vibrating, and sets a predetermined reset time in a reset counter for the latch element associated with the detected string, down-counts the reset counter in an interrupt routine executed for every predetermined time, and resets the latch element upon elapse of the reset time (see FIG. 14). With the above arrangement, the string triggering is assuredly detected at a high speed.

Figure 15:
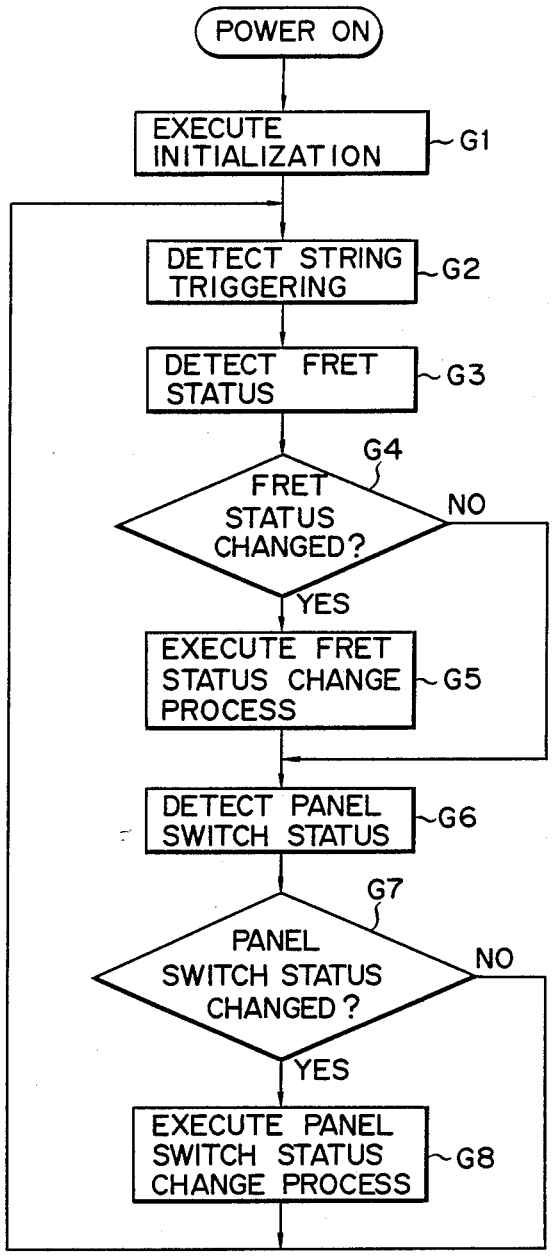
FIG. 15 is a general flowchart for a microcomputer shown in FIG. 13.

General Flow (FIG. 15)

FIG. 15 illustrates the general flow of the aforementioned microcomputer 30L. In fret status detection steps G3 and G4, microcomputer 30L checks if a change occurs in the status of any fret switch FSW by data transmission with switch status detector 50L. If there is a change in fret status found in the above steps, a process associated with the change is performed in step G5. Specifically, in step G5, the fret operation position (also including the open string position) for each string is detected, and, with respect to the present fret operation position differing from the previous one, its data (fret number) is updated. (Of course, step G5 includes other operations; however, they are not related with this invention, their explanation will be omitted here.) Steps G6 and G7 respectively involve a panel switch status detection and a discrimination as to whether or not there is a change in panel switch status. If there is such a change found, the flow advances to step G8 for execution of a process associated with the change. Step G8 also deals with a process associated with a change in the status of mode select switch MSW; the value set in the mode flag changes upon every operation of mode select switch MSW. For instance, the mode flag being "1" represents that the timbre select mode has been set while "0" represents that the normal play mode has been set.

As explained earlier, in step G2 which involves detection of the string triggering, the present latch sample is compared with the previous one to detect which string has been triggered, the mode flag is referred to for confirmation of the present mode and an associated one of different mode-originated operations is executed in accordance with the mode. In other words, if the timbre select mode is presently set, the timbre setting process is executed, and if the normal play mode is the present mode, the normal play process is executed. A detailed description of the mode-originated process will now be given.

Mode-Originated Process

The mode-originated process is illustrated by the same flowchart as shown in FIG. 6. This process is, however, executed in the first embodiment as part of the interrupt process, whereas it is executed in the second embodiment as part of the string trigger detection process. This is an insignificant difference. Another difference lies in that the normal play process in the second embodiment, which corresponds to step D3 in the first embodiment, is executed for all the strings, not only one string.

Figure 16:
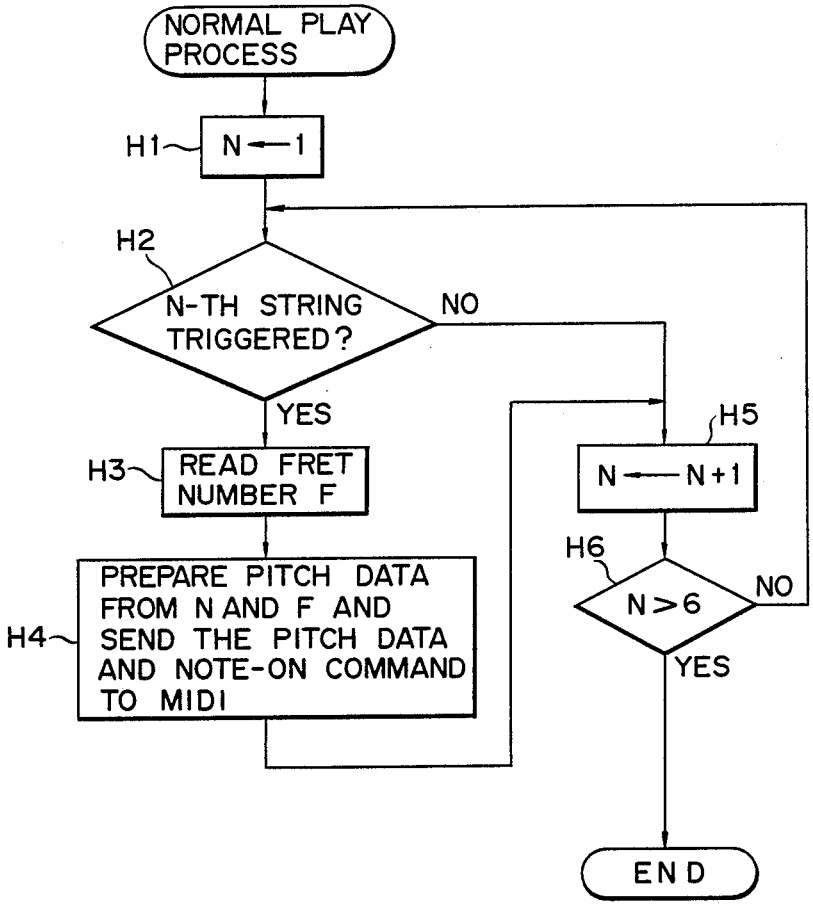
FIG. 16 is a flowchart illustrating a normal play process included in mode-originated processes executed by the microcomputer in a string trigger detecting process shown in FIG. 15.

Normal Play Process (FIG. 16)

In the second embodiment, the normal play process is executed in accordance with the flow as shown in FIG. 16. The fundamental difference from that of the first embodiment lies in that this process involves no pitch extraction and includes instead the step (H3) of reading the fret number F. What is read in step H3 is of course the data of the fret number which has been updated and stored in a memory in step G5 of FIG. 15 that should be executed upon occurrence of a change in fret status.

The variable N indicates a string number and can take six values between 1 and 6 respectively associated with the first to sixth strings. If no string is triggered, the loop of steps H2, H5 and H6 is repeated five times, and as Nis detected in step H6 in its sixth loop process, the flow leaves the loop. (Substantially, nothing is done in this case.) Steps H3 and H4 are executed with respect to a string which has been triggered. Step H4, like step E4 of FIG. 7, performs the note-on process with a result that a musical tone of the triggered string is produced in external sound source 70.

Figure 17:
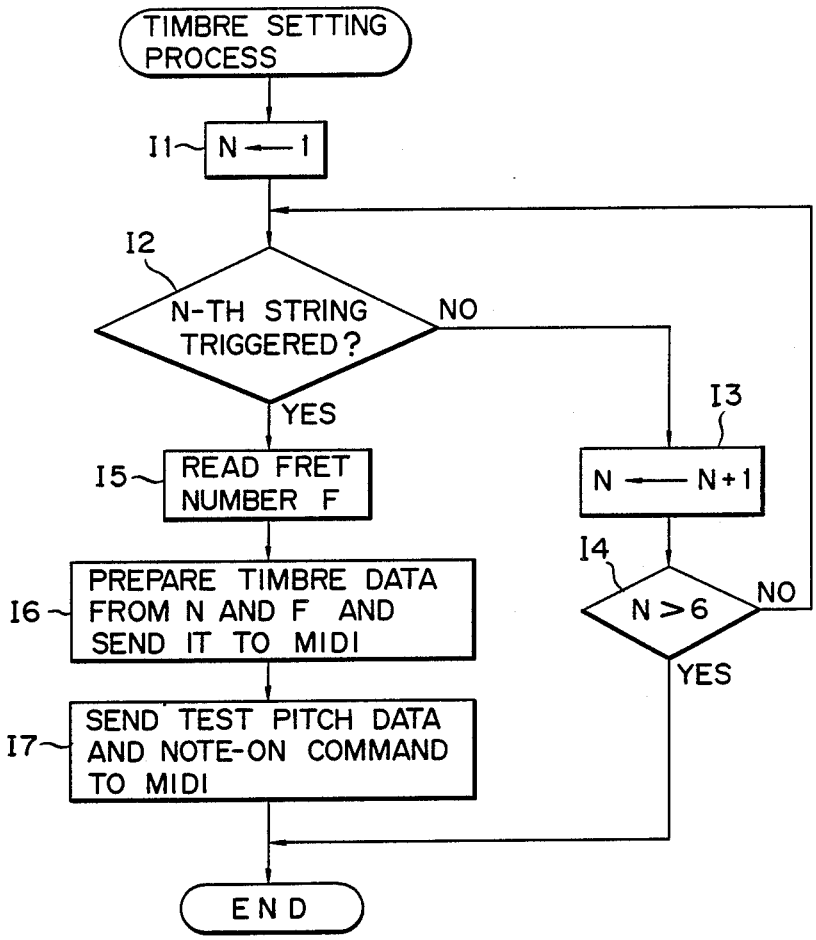
FIG. 17 is a flowchart illustrating a timbre setting process included in the mode-originated processes executed by the microcomputer.

Timbre Setting Process (FIG. 17)

The timbre setting process is executed in accordance with the flow shown in FIG. 17. In this flow, steps I5 through I7 are executed with respect to only the first string triggered, not all the strings triggered, because it is unnecessary to consider any chord play. Assume that the picking of the second string is done with its seventh fret depressed, the fret number data "7" is memorized for the second string in step G5. And, in the flow of the timbre setting process (FIG. 17), the string triggering is detected in discrimination step I2 when N=2. Consequently, the flow advances to step I5 where the stored fret number data for the second string is read out. In the next step I6, timbre data is prepared from the fret number data F and string number data N and is sent to MIDI interface 60. The flow then advances to step I7 where test pitch data (e.g., the note number of pitch C4) and a note-on command are sent to MIDI interface 60. As a result, new timbre data is set in external sound source 70 which in produces a musical tone with the set timbre and pitch C in response to the node number of the pitch C4 and the note-on command. This musical tone is generated through sound system 100 and is confirmed by the user.

According to the string trigger/fret switch type electronic musical instrument, it is unnecessary to extract the fundamental frequency data so that conversion to timbre data is easy and accurate. This is because the depressed position on the picked string (fret operation position) is detected by the ON state of the presently-depressed fret switch FSW, thus eliminating the need to specify the fret operation position based on the fundamental frequency data.

[Third Embodiment (FIGS. 18 to 21)]

Both of the first and second embodiments are electronic stringed instruments with a MIDI function, determine whether normal play data or timbre select data is to be given to an external sound source (or an external electronic musical instrument) in accordance with the mode indicated by mode select switch MSW. In contrast, the electronic stringed according to the third embodiment to be described below has a rhythm sound source and a melody sound source (for a chord play) as internal sound sources and has a mode select switch to switch between the normal play mode and rhythm pattern setting mode. In the normal play mode, the internal melody sound source is controlled in response to a picking signal to produce a musical tone associated with the picking signal. In the rhythm pattern setting mode, a specific rhythm pattern is selected in accordance with the position of the operated fret on the fingerboard. When a rhythm start is instructed after mode select switch MSW is set back to the normal play mode, the set rhythm pattern is automatically played. A more detailed explanation of the third embodiment will be given below, with that portion common to the first and second embodiments being omitted.

Figure 18:
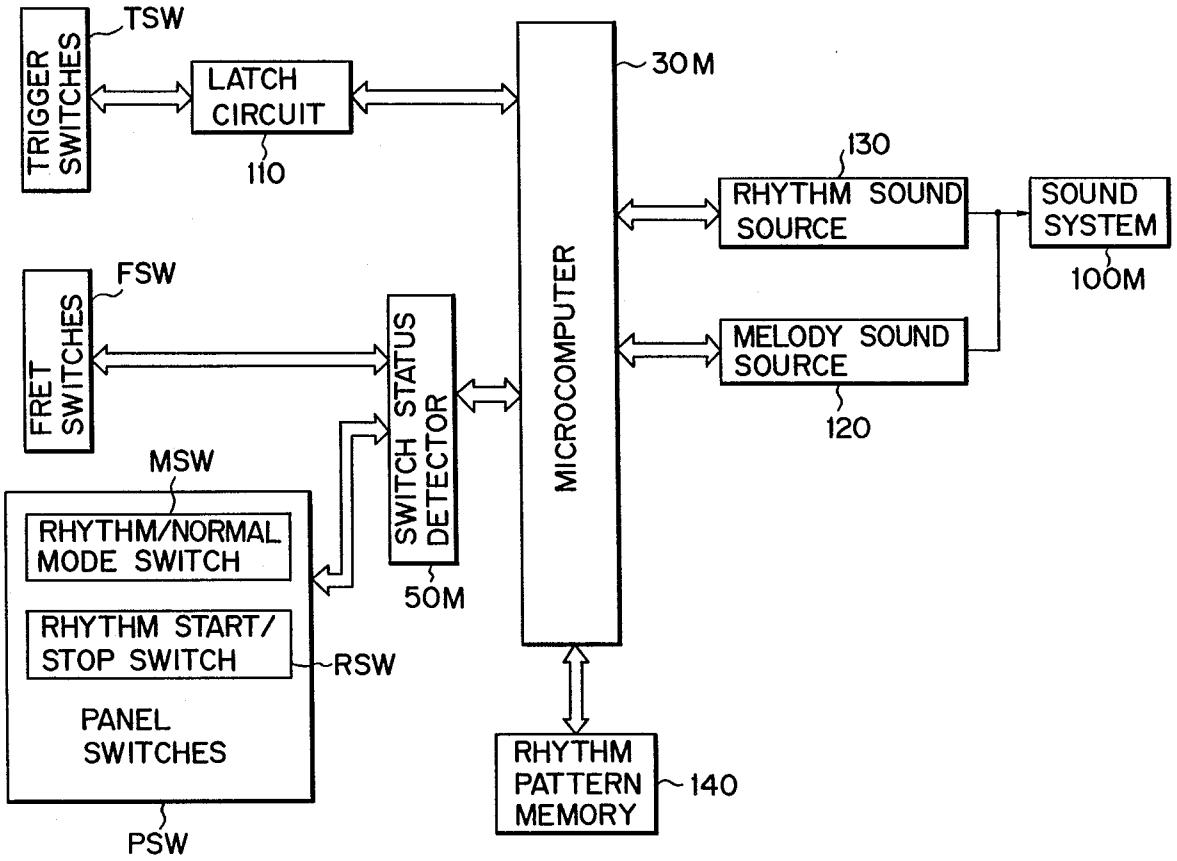
FIG. 18 is a diagram illustrating the overall structure of an electronic stringed instrument according to a third embodiment.

Overall Circuit Structure (FIG. 18)

FIG. 18 illustrates the overall circuit structure of an electronic stringed instrument according to this embodiment. As illustrated, the picking signal input device comprises string trigger switches and fret switches as per that of the second embodiment. That is, the trigger switches and fret switches may have the same structures the same functions as those used in the second embodiment. A melody sound source and a rhythm sound source, respectively denoted by numerals "120" and "130," are internal sound sources of the electronic stringed instrument. Melody sound source 120 produces musical tones associated with string picking, while rhythm sound source 130 produces musical tones for automatic rhythm play. A microcomputer 30M has a function for the automatic rhythm play and panel switches PSW include a switch associated with a rhythm. Specifically, mode select switch MSW of the third embodiment serves to switch between the rhythm select mode and normal play mode of the electronic stringed instrument, and a rhythm start/stop switch RSW, one of the panel switches, serves to start and stop a selected rhythm pattern.

The structure of the main body of this electronic stringed instrument, though not illustrated, is very similar to that of the second embodiment. The sound system M shown in FIG. 18 may be mounted in the body of the electronic stringed instrument or its component, a speaker or the like, may be of a stand alone type.

Numeral 140 is a rhythm pattern memory for storing rhythm patterns, and a specific rhythm pattern is selected in the rhythm select mode. In the rhythm automatic play, the pattern is repeatedly read out from the memory by microcomputer 30M and rhythm sound source 130 is driven in accordance with the pattern.

Figure 19:
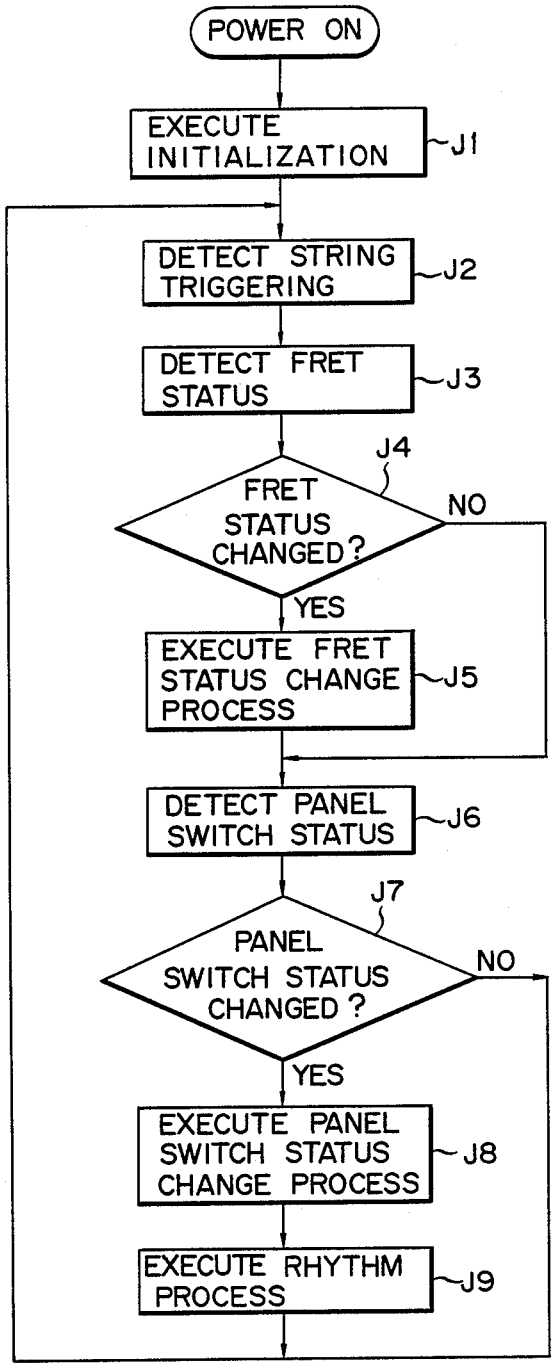
FIG. 19 is a general flowchart for a microcomputer shown in FIG. 18.

General Flow (FIG. 19)

FIG. 19 illustrates the general flow of microcomputer 30M, which is similar to the one for the second embodiment as shown in FIG. 15. The differences lie in that:

(A) The third embodiment is directed to musical instrument with built-in sound sources whereas the second embodiment is directed to a MIDI instrument adapted to be coupled to an external sound source, and (B) The instrument of the third embodiment has the automatic rhythm play function.

In other words, with regard to difference (A), microcomputer 30M of this embodiment communicates with internal sound sources 120 and 130 with the protocol proper for these sound sources, whereas microcomputer 30L of the second embodiment, like that of the first embodiment, communicates with MIDI interface 60 with the MIDI protocol. Therefore, the second and third embodiments use different data formats and different synchronous systems, which are, however, well known and are the matter of design choice. In this respect, this difference (A) is not apparent in the flow shown in FIG. 19. The difference (B) concerning the automatic rhythm play function is shown in the flow as the rhythm process executed in step J9.

This rhythm process J6 may be fundamentally the as the conventionally well-known rhythm process. As will be described later, however, when a rhythm pattern is selected in the rhythm select process (which is executed as part of string trigger detection process J2 as per the second embodiment), the rhythm pattern is sounded once in order to inform the user of the content of the selected rhythm pattern, and a single test flag is used for this test pattern process.

A process for an input through rhythm start/stop switch RSW is executed part of panel switch status change process J8, and every time this switch RSW is depressed, the value of the rhythm flag is switched between a value specifying the rhythm start and the one specifying the rhythm end. A process concerned with mode select switch MSW (rhythm/normal mode select switch) is also executed in panel switch status change J8, and every time this switch RSW is depressed, the value of the mode flag is switched between a value specifying the normal play mode and the one specifying the rhythm select mode.

In string triggering detection process J2, data indicating which string has been triggered is acquired by comparing the present sampled value of latch circuit 110 with the previous sample value. For instance, the detection process is executed in such a manner that the least significant bit of an 8-bit register represents the occurrence or non-occurrence of the triggering of the first string, the second least significant bit represents the occurrence or non-occurrence of the triggering of the second string, so forth up to the sixth bit representing the occurrence or non-occurrence of the triggering of the sixth string. Then, the occurrence or non-occurrence of the triggering can be checked by right-shifting this register in accordance with the string number variable N and checking if a carry is present or not. After the trigger indication data is prepared, the mode flag is referred to, and if the flag's value indicates the rhythm select mode, the rhythm setting process is executed, and if it indicates the normal play mode, the normal play process is executed (see FIG. 20).

Figure 20:
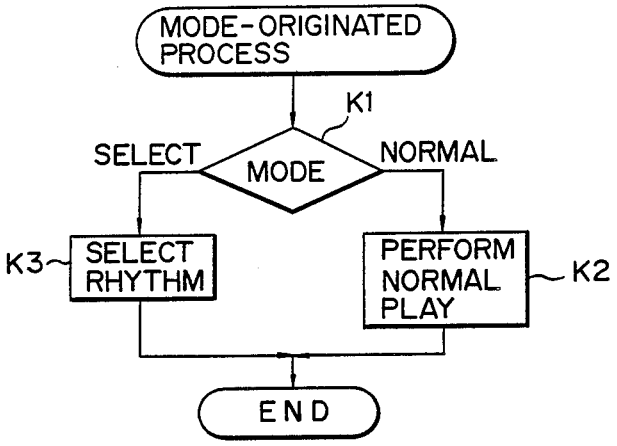
FIG. 20 is a flowchart illustrating a more-originated process executed by the microcomputer in the string trigger detecting process shown in FIG. 15.

Mode-Originated Process (FIG. 20)

FIG. 20 illustrates the flow for the mode-originated process. The normal play process K2 is executed in accordance with almost the same flow as shown in FIG. 16. However, the step corresponding to step H4 of FIG. 16 is executed with respect to internal melody sound source 120 (FIG. 18), and not the MIDI interface. Therefore, the content of normal play process K2 is apparent and should need no further explanation.

Figure 21:
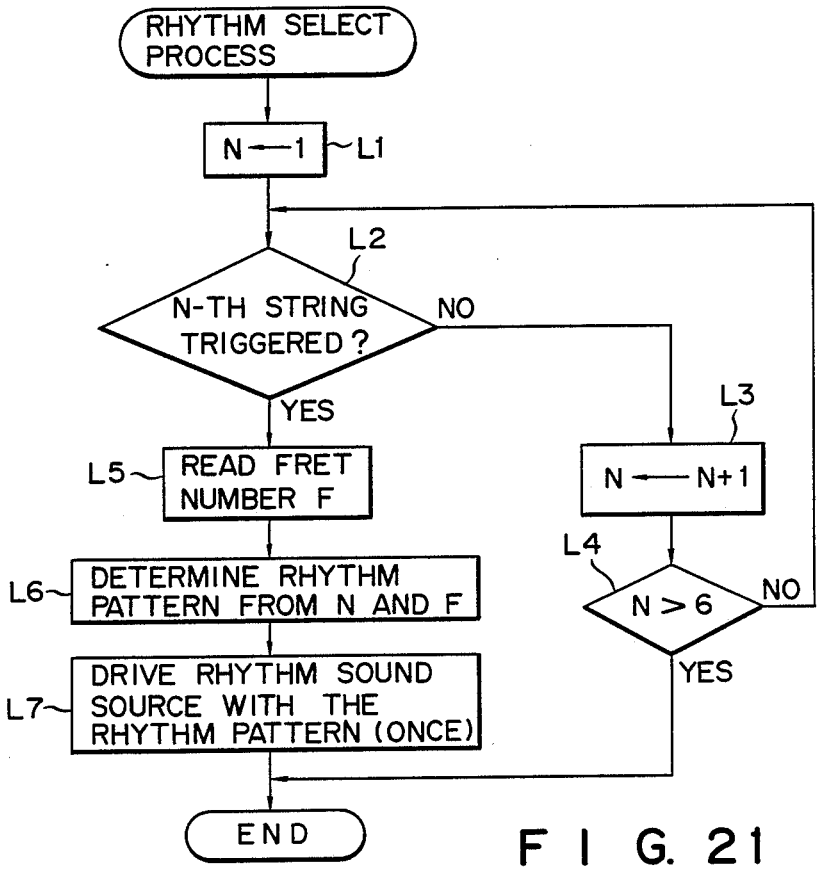
FIG. 21 is a detailed flowchart of a rhythm select process shown in FIG. 20.

Rhythm Select Process (FIG. 21)

Step K3 of FIG. 20 is the rhythm select process whose flow is briefly illustrated in FIG. 21. The loop of steps L2–L4 is repeated while incrementing the string number N until any string triggering is detected. If string triggering is detected, the flow then advances to step L5 where the fret operation number F (the one for the N-th string) updated and held in fret status change process J5 is read out. In the step L6, a rhythm pattern is determined on the basis of the fret number F and string number N (this discrimination step being executed by a conversion table or through computation). In the last step L7, rhythm sound source 120 is driven in accordance with the rhythm pattern. This rhythm pattern is played only once and is not repeated so that the user can confirm the content of the selected rhythm pattern through a sound via sound system 100M.

To be specific, step L7 executes the process for starting the rhythm pattern. That is, the start address of the rhythm pattern in rhythm pattern memory 140 is calculated on the basis of the rhythm pattern name already determined in step L6, the rhythm counter (which is cyclically driven by the length of a rhythm pattern) is initialized, the start address of the rhythm pattern is read out, and data is supplied to rhythm sound source 130, in accordance with the content of the address (data which is to be sounded and indicates, for example, whether or not a bass drum should be ON). (As a result, the beginning portion of the rhythm pattern is sounded.) Further, microcomputer 30M sets a test flag, rhythm flag and rhythm run flag in such a way that a rhythm is automatically stopped after a single play of the rhythm pattern.

When the flow advances to rhythm process J9, microcomputer 30M, going through the discrimination steps for the rhythm flag and rhythm run flag, increments the rhythm counter upon every arrival of the increment time of the rhythm counter, reads out the content of the address specified by a rhythm counter value i plus a rhythm pattern start address, i.e., the i-th rhythm pattern from the beginning, and controls the tone generation of rhythm sound source 130 in accordance with the read content. The value of the rhythm counter will eventually reach the rhythm pattern length. In other words, after controlling the tone generation of rhythm sound source 130, microcomputer 30M discriminates whether or not the value of the rhythm counter becomes the rhythm pattern length. If it equals the rhythm pattern length, the flow advances to the discrimination for the test flag. As the test flag is set, the rhythm stop process is executed after resetting the test flag. If the test flag is discriminated in the discrimination step to be in its reset state, microcomputer 30M leaves the flow, and initializes the rhythm counter at the next increment time to start sounding the pattern again from the beginning of the pattern. That is, the beginning portion of the rhythm pattern is sounded in rhythm pattern select process L7; thereafter, the aforementioned process is executed every time the flow advances to rhythm process J9 and the rhythm is stopped after it is sounded by one rhythm pattern.

If the user hearing the content of the rhythm pattern finds its undesirable, picking of another string can be performed with a fret for this string is depressed. Accordingly, a new rhythm pattern is set and it is sounded once.

The following briefly describes the operation of rhythm start/stop switch RSW. When a rhythm start is instructed, the rhythm flag is set first in the panel switch status change process. In the rhythm process, after going through the discrimination for the rhythm flag, the flow advances to the discrimination step for the rhythm run flag. As the rhythm is not running, the selected rhythm is started. Here, the rhythm run flag is set but not the test flag. Thereafter, every time the flow enters rhythm process J9, the discriminations for the rhythm flag and rhythm run flag are executed, the rhythm pattern address is incremented upon each arrival of the timing to drive rhythm sound source 130, and the rhythm pattern is repeatedly automatically played by setting the rhythm pattern address back to the start address after it reaches the end address. When rhythm start/stop switch RSW is depressed again, the rhythm flag is reset in panel switch status change process J8. If the flow enters rhythm process J9, the flow branches to the stop side in the discrimination for the rhythm flag to discriminate whether or not the rhythm is running. As the rhythm is running here, the rhythm run flag is reset and the rhythm stop process is executed. If the rhythm run flag has not ben set, the rhythm stop process is skipped In brief, according to the third embodiment, if the user desires to change a rhythm pattern, the user depresses mode select switch MSW mounted on the instrument main body to set the rhythm select mode in advance. Subsequently, to select the desired rhythm pattern, the user depresses some fret for some string and performs picking of the string. In response to the picking, microcomputer 30M finds the rhythm pattern desired by the user from the picked string and its fret position. And, the rhythm pattern is sounded only once through rhythm sound source 130 and sound system 100M. If the user hearing the sound finds the rhythm pattern the desired one, the user depresses mode select switch MSW again to set the mode back to the normal play mode. Thereafter, a sound is prepared in melody sound source 120 in accordance with the string picking, and when the rhythm start is instructed, the set rhythm pattern is automatically played (automatic accompaniment in this case).

A synchronous start switch or the like may be added to the instrument so that when a guitar play is started (i.e., when picking of a string is done), a rhythm is simultaneously started. (This technique is well known.)

[Fourth Through Seventh Embodiments (FIGS. 22 to 25)]

FIGS. 22–25 illustrating the forth through seventh embodiments described below illustrate the arrangements which, in the select mode set, prevent a musical tone unintended by the player from being selectively set when a plurality of strings are simultaneously picked, or in a state undesirable for the player, e.g., when a specific string is picked with the open string operational status. These embodiments are classified into two different types of electronic stringed instruments for further explanation.

The fourth and fifth embodiments are directed to a string trigger type electronic stringed instrument, and the sixth and seventh embodiments are directed to a pitch extraction type electronic stringed instrument.

Figure 22:
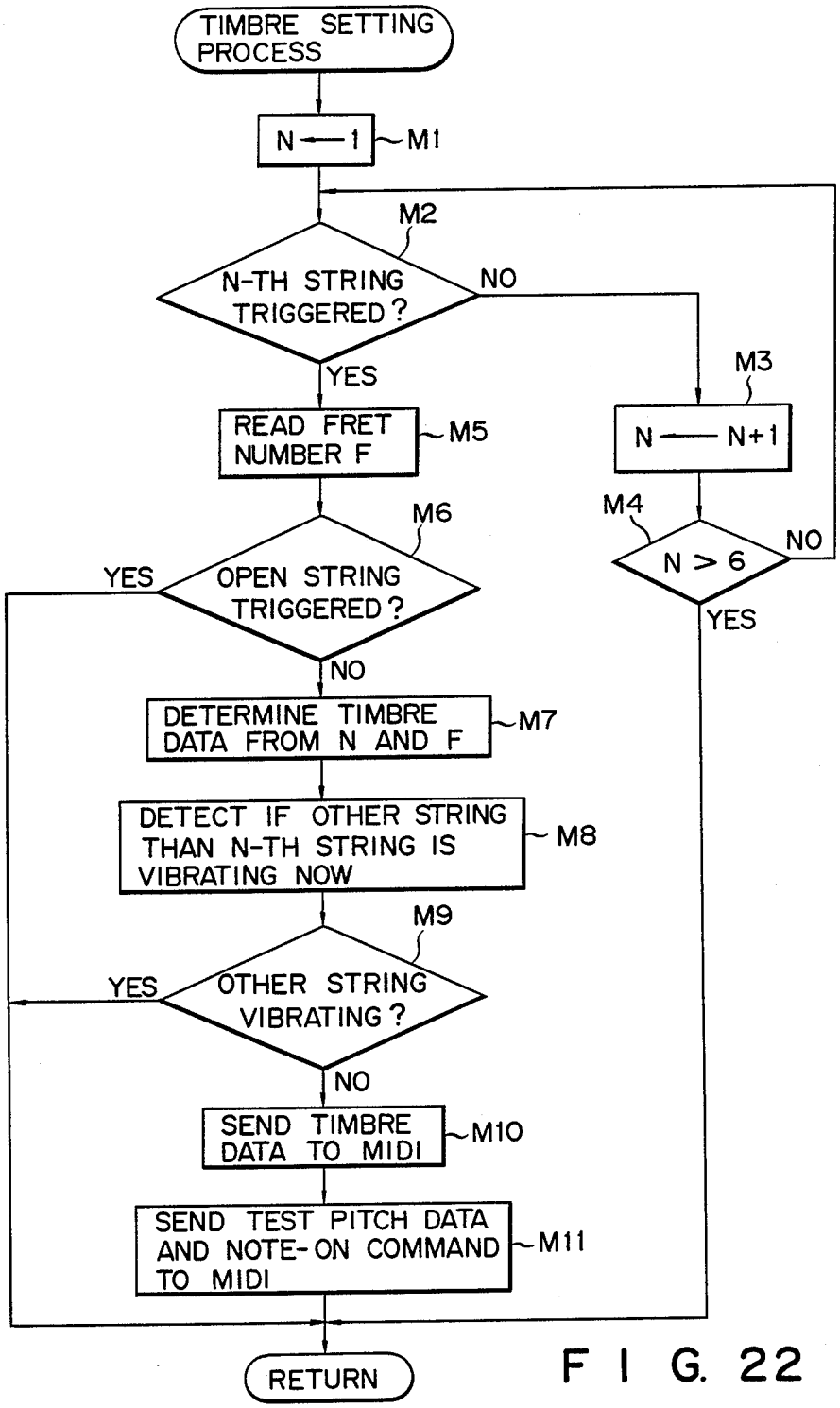
FIG. 22 is a flowchart illustrating a timbre setting process involved in a fourth embodiment.
Figure 23:
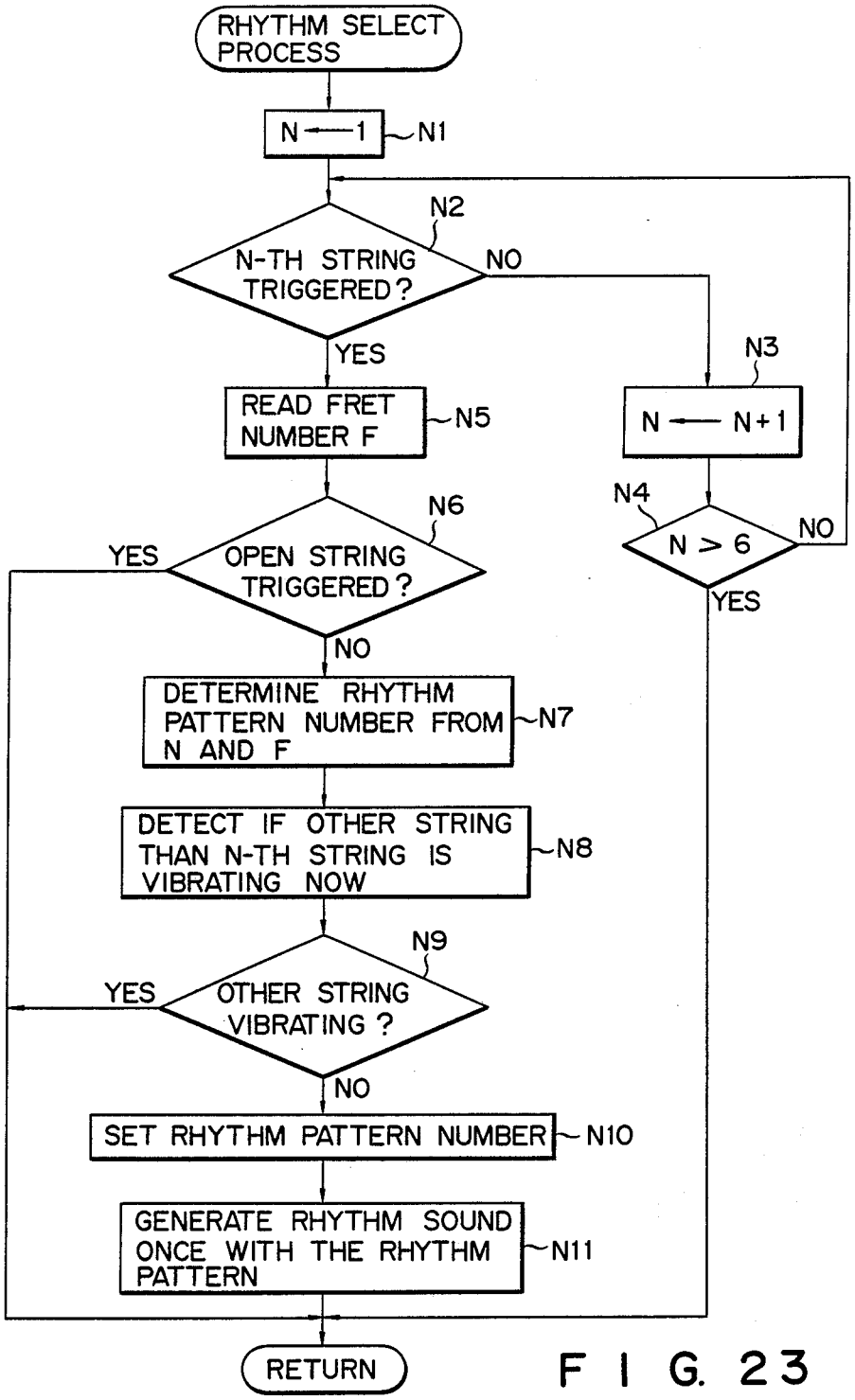
FIG. 23 is a detailed flowchart illustrating a rhythm select process involved in a fifth embodiment.

Fourth Embodiment (FIG. 22)

To begin with, an explanation of the fourth embodiment will be given.

The major difference between the fourth embodiment and the above-described first through third embodiments is that the fourth embodiment is concerned with the case in which a plurality of strings are simultaneously picked with a specific fret position depressed or with an open string operational status, whereas the first to fourth embodiments are concerned with the case in which one string is picked with a specific fret position depressed. Therefore, the fourth embodiment will be explained mainly with respect to this difference.

Timbre Setting Process (FIG. 22)

The timbre setting process of this embodiment, different from the one involved in the second embodiment (see FIG. 17), is executed in accordance with the flow exemplified in FIG. 22.

Steps M1 through M5 are the same as the individual steps 11 through I5 of the flow of the second embodiment shown in FIG. 17. In step M6, if the fret number F read out in response to detection of string triggering corresponds to the value of an open string number (YES in the step), the flow leaves this routine for the timbre setting process. If NO in this step, the flow advances to step M7 where timbre data is determined from the number N of the presently picked string and the fret number F.

In the subsequent step M8, the data area of microcomputer 30 is searched in order to check whether or not another string than the N-th string is vibrating through a picking operation. If it is discriminated in the next step M9 that other string has been triggered (YES), the present picking operation is disregarded. If NO in step M9, the flow advances to step M10 where the timbre data determined in step M7 is sent to MIDI interface 60. When the fret number F and string number N are determined, a specific timbre is determined as shown in FIG. 9. As a result of the process executed in step M10, the timbre of a musical tone to be generated is updated and set in external sound source 70. In the subsequent step M11, test pitch data (for example, the note number of pitch C4) and a note-on command are sent to MIDI interface 60. As a result, external sound source 70 produces the musical tone with the timbre set in the previous step M10 and the pitch C4.

When a plurality of strings are simultaneously operated, vibration of each string is judged in step M9. In this case, if the vibration of each string is settled at a time greater than the one involved in the normal play mode, the accuracy of discriminating whether or not a plurality of strings are simultaneously operated. That is, even if picking operation of a plurality of strings is substantially simultaneously executed, it is not desirable that an electronic circuit, particularly, microcomputer 30 detect the first string operated, determine the depressed frets and set timbre data in external sound source 70. To avoid this, therefore, it is desirable to take a little time to judge if simultaneous operation of other strings is performed.

In other words, when an arbitrary string vibrates, microcomputer 30 needs to start a timber upon detection of the string vibration, detect vibration of other strings upon elapse of a predetermined time, and make the negative decision (NO) in step M9 only when it is a single string vibrating.

As should be clear from the above explanation, when picking of strings with an open string operation status is performed, the flow leaves the routine for the timbre setting process at step M6. Therefore, even when a finger erroneously or accidentally touches a string with the open string operation status and the string triggering is detected as a consequence, it is possible to prevent a timbre from being erroneously set.

When a plurality of strings are erroneously or accidentally operated with a fret operational status, not the open string operation status, it is not clear as to what timbre should be set. In this case, therefore, the flow leaves the routine for the timbre setting process at step M9, thus preventing a timbre unintended by the player from being erroneously set.

[Fifth Embodiment (FIG. 23)]

The following explains the fifth embodiment according to which the same process as is executed in the fourth embodiment as shown in FIG. 22 is done.

When picking of a string is performed with the open string operation status, it is YES in step N6 and the flow leaves this routine for the rhythm select process. Therefore, even if a string is erroneously touched with the open string operation status and the string triggering is detected as a consequence, erroneous setting of a specific rhythm pattern can be prevented.

When a plurality of strings are simultaneously triggered, the decision in step N9 is YES and the flow leaves the routine for the rhythm select process, thus preventing erroneous setting of a rhythm pattern unintended by the player in this case too.

Steps N1–N5, N7, N10 and N11 are the same as the corresponding steps in the flow shown in FIG. 16 so that their explanation will be omitted here.

[Sixth Embodiment (FIG. 24)]

The following is an explanation of the sixth embodiment.

Like the fourth embodiment shown in FIG. 22, the sixth embodiment executes a process for inhibiting erroneous setting of a specific timbre when picking of a single string or simultaneous picking of a plurality of strings is performed with the open string operation status. Therefore, an explanation will be given only of the timbre setting process which includes that process.

Figure 24:
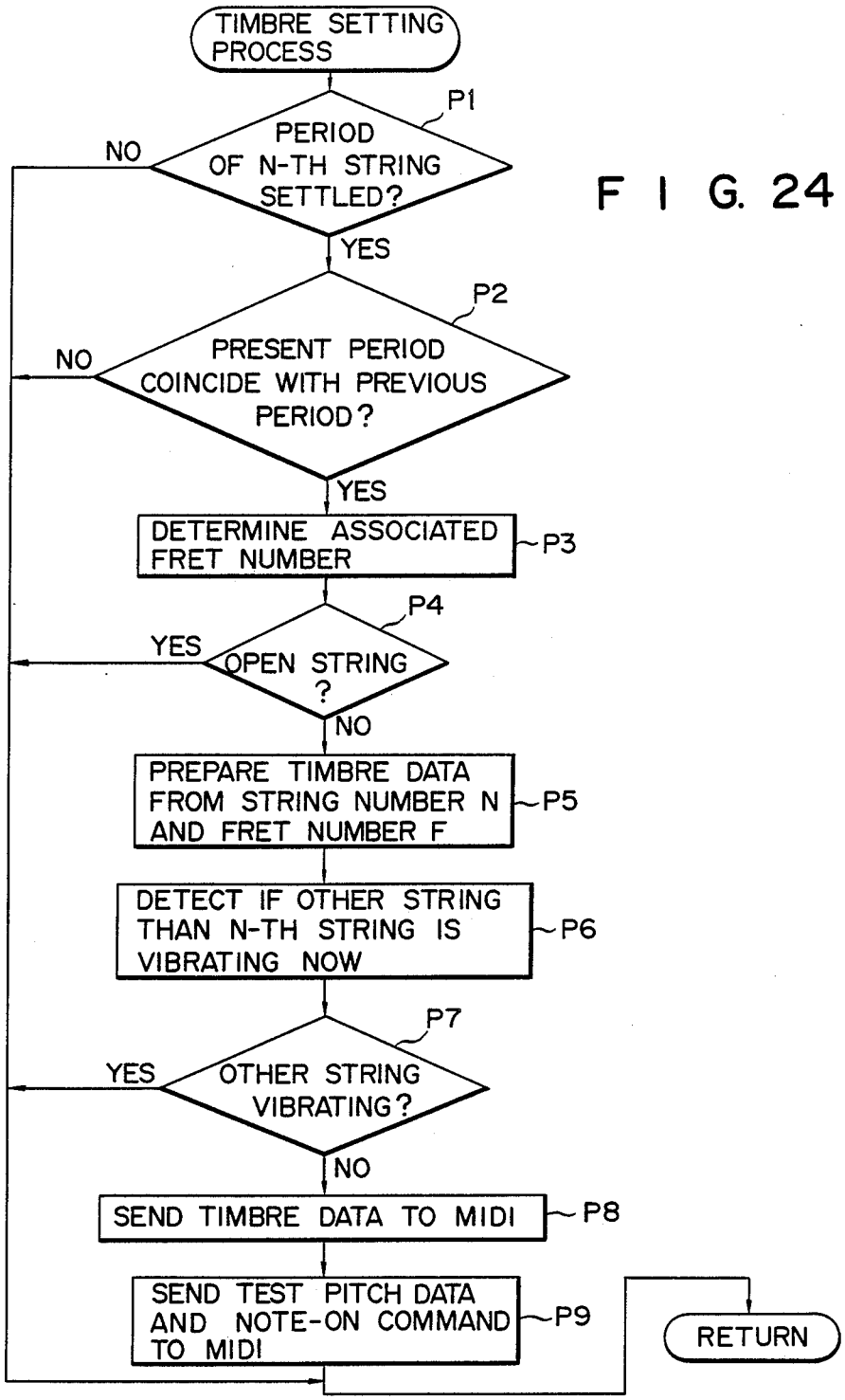
FIG. 24 is a flowchart illustrating a timbre setting process involved in a sixth embodiment.

Timbre Setting Process (FIG. 24)

FIG. 24 is a detailed illustration of the timbre setting process. First, in step Pl, it is checked if the vibration period of a string of interest is settled or not. If it is settled, the flow advances to step P2 where it is checked if the present period substantially coincides with the previous period (by comparing the content of the present period data memory with that of the previous period data memory). If a coincidence is attained within a predetermined allowance, the flow advances to step P3 where the associated fret number F is determined. If the fret number F corresponds to the value of the open string in the subsequent step P4, the decision is YES and the flow returns to the original one. If it is NO in step P4, timbre data is prepared from the number N of the string in interest and the determined fret number F in step P5.

In the subsequent step P6, the data area of microcomputer 30 is searched in order to check whether or not another string than the N-th string is vibrating through a picking operation. If it is discriminated in the next step P7 that other string has been triggered (YES), the present picking operation is disregarded. If NO in step P7, the flow advances to step P8 where the timbre data determined in step P5 is sent to MIDI interface 60. When the fret number F and string number N are determined, a specific timbre is determined as shown in FIG. 9. As a result of the process executed in step P8, the timbre of a musical tone to be generated is updated and set in external sound source 70. In the subsequent step P9, test pitch data (for example, the note number of pitch C4) and a note-on command are sent to MIDI interface 60. As a result, external sound source 70 produces the musical tone with the timbre set in the previous step P8 and the pitch C4.

When a plurality of strings are simultaneously operated, until the vibration period of each string is determined or until the decision in step Pl becomes YES, the same interrupt process is executed for other strings. And as the other strings are also vibrating, the decision in step P7 becomes YES. Further, if the vibration of each string is settled at a time greater than the one involved in the normal play mode, the accuracy of discriminating whether or not a plurality of strings are simultaneously operated That is, even if picking operation of a plurality of strings i substantially simultaneously executed, it is not desirable that an electronic circuit, particularly, microcomputer 30 detect the first string operated, determine the depressed frets and set timbre data in external sound source 70. To avoid this, therefore, it is desirable to take a little time to judge if simultaneous operation of other strings is performed.

In other words, when an arbitrary string vibrates, microcomputer 30 needs to start a timber upon detection of the string vibration, detect vibration of other strings upon elapse of a predetermined time, and make the negative decision (NO) in step M9 only when it is a single string vibrating.

As should be clear from the above explanation, when picking of strings with the open string operation status is performed, the flow leaves the routine for the timbre setting process at step P4. Therefore, even when a finger erroneously or accidentally touches a string, it is possible to prevent a timbre from being erroneously set.

When simultaneous picking of a plurality of strings is performed, it is often difficult to detect based on which string picking, the timbre has been set. In this respect, therefore, when such string picking is performed, the flow leaves the routine for the timbre setting process at step P7 so as to make the timbre setting invalid, thus preventing erroneous timbre setting.

[Seventh Embodiment (FIG. 25)]

Figure 25:
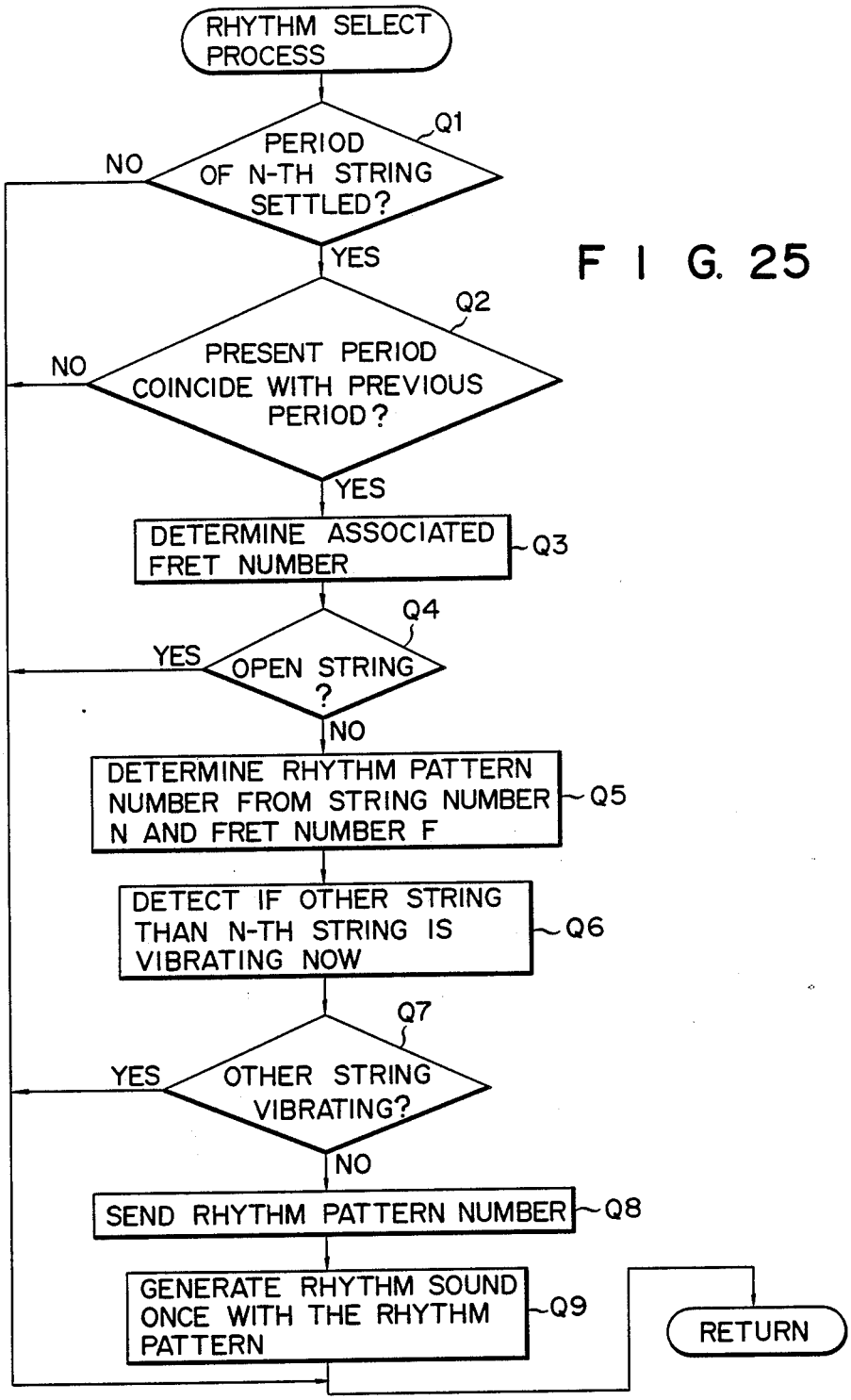
FIG. 25 is a flowchart illustrating a rhythm select process involved in a seventh embodiment.

The seventh embodiment will now be explained referring to FIG. 25.

As is the case of the fifth embodiment (FIG. 23), according to the seventh embodiment, when string picking with the open string operational status is detected in the sequence of steps Q1–Q4, i.e., when YES in step Q4, the flow leaves the routine for the rhythm select process and does not go through steps Q5–Q9. With this flow, therefore, when string picking is executed with the open string operation status, this is considered as if the string is erroneously or accidentally touched by a finger and is handled as such. This can therefore prevent erroneous selection and setting of a rhythm pattern.

When simultaneous picking of a plurality of strings is discriminated in step Q7 (i.e., YES in this step), the flow leaves the routine for the rhythm select process so as not to execute the selection and setting of a rhythm pattern (steps Q8 and Q9). This can prevent erroneous setting of a rhythm pattern undesirable for the player at the time of rhythm pattern selection.

[Modifications]

This invention is in no way limited to the above particular embodiments but can be modified and improved in various manners within a scope and spirit of this invention. For instance, as a modification of the third embodiment, mode select switch MSW may be designed to switch among three modes, namely, the rhythm select mode, timbre select mode and normal play mode and microcomputer 30M may be provided with the necessary functions for the modification. This invention may also be applied to an electronic stringed instrument which has an internal sound source as well as such a function as the MIDI function to communicate with an external musical instrument. This modification is easy to make. It is also possible to add a mode for selecting a song number. Other various modifications may be easily made.

According to the individual embodiments, when picking of a predetermined string at the fret operation position is performed, a player can confirm what kind of a timbre or rhythm pattern has been set by listening a musical tone with the set timbre or a rhythm sound according to the set rhythm pattern data. This invention is not, however, limited to this type. There may be a case in which when the present parameter is changed to a predetermined timbre, etc. through the aforementioned picking operation while playing a music on a stage or the like, the player does not want audience to hear a musical tone with the set timbre, etc. In this case, to inhibit generation of such a musical tone, as shown in FIGS. 1 and 10, a switch PUW may be provided which is used for instructing whether or not the test musical tone or rhythm pattern should be generated. Further, the instrument may be designed so that at the time a musical tone with a predetermined timbre, etc. is set through string picking, the musical tone is not generated at all.

This invention is also applicable to other types of electronic stringed instruments than those explained above.

Figure 26:
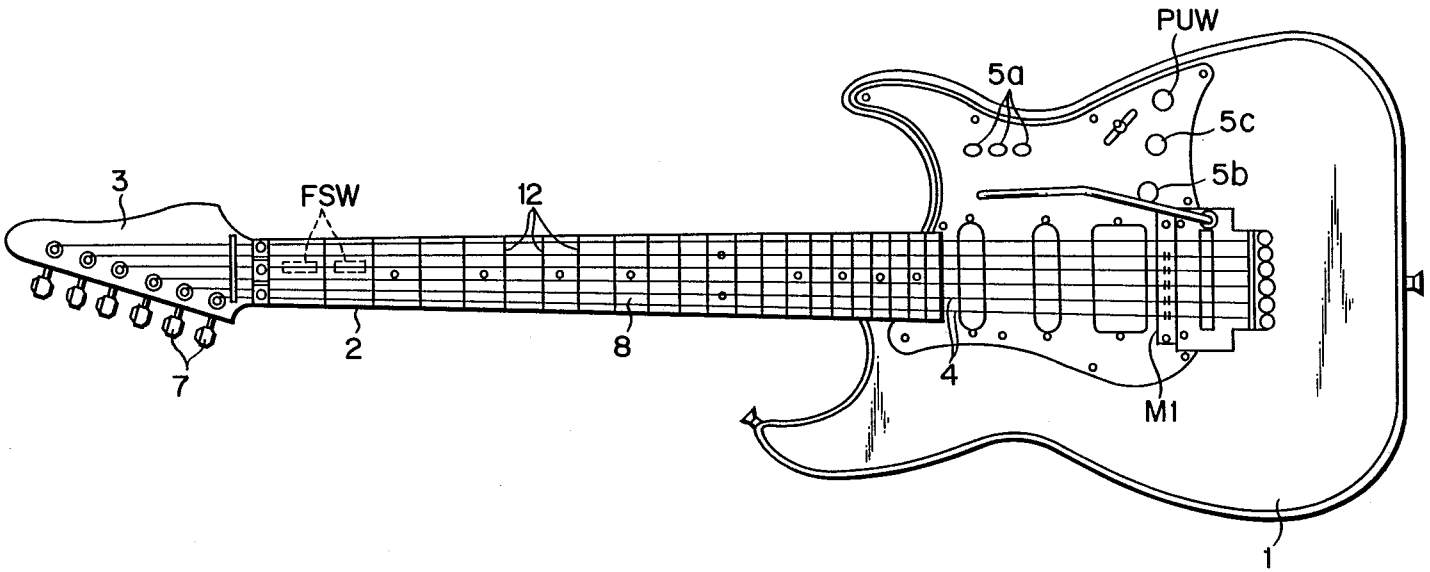
FIG. 26 is a general plan view of another type of an electronic instrument to which this invention is applicable.

For instance, as shown in FIG. 26, this invention can apply to an electronic stringed instrument in which by turning on a fret switch FSW mounted in fingerboard 8, the pitch corresponding to the fret switch FSW is designated and a musical tone with the designated pitch is generated at the output timing of a pickup signal detected by an electromagnet type pickup sensor M1 provided on body 1. This invention is also applicable to the following types of electronic stringed instruments.

The following types may be applied as the pitch designating section for designating the pitch of a musical tone to be generated.

(1) The type which has a resistance member for each string whose resistance is detected (refer to U.S. Pat. No. 4,235,141, for example).

(2) The type which detects a string-depressed position from electric contact between a conductive string supplied with a small current and a fret contact (refer to U.S. Pat No. 4,468,997, for example).

(3) The type which detects the pitch by supplying an ultrasonic wave in strings and measuring the return time of the wave from a string-depressed position.

The following types may be applied to the ton generation start section for starting generation of the musical tone with the designated pitch.

(1) The type which detects the axial directional vibration of a string using a Hall element and a magnet (refer to U.S. Pat. No. 4,658,690, for example).

(2) The string trigger switch type which is actuated by the vibration of a string to detect the beginning of the string vibration (refer to U.S. Pat. No. 4,336,734, for example).

(3) The piezoelectric element detecting type which detects the string vibration using a piezoelectric element (refer to U.S. Pat. No. 4,657,114, for example).

(4) The light pickup type which detects the string vibration form the light shielding state (refer to U.S. Pat. No. 4,688,460, for example).

What is claimed is:

1. An electronic stringed instrument comprising:

picking-data output means for detecting a status of a picking operation with respect to at least one string at a plurality of fret operation positions and outputting picking data including pitch designation data for specifying a musical tone having a specific pitch and string trigger data for specifying a generating timing for a musical tone;

mode selecting means for selectively setting a normal play mode and at least one other selection mode;

tone generating means for, when said pitch designation data is output from said picking-data output means in response to said picking operation, with said normal play mode being set by said mode selecting means, generating a musical tone having a pitch specified by said pitch designation data, at a timing indicated by said string trigger data; and musical tone parameter setting means for, when said pitch designation data is output from said picking data output means in response to said picking operation, with said at least one selection mode being set by said mode selecting means, selecting and setting a specific one of a plurality of musical parameters, in accordance with said picking data output from said picking-data output means.

2. The electronic stringed instrument according to claim 1, wherein said picking-data output means includes pickup devices provided for associated strings, pitch extraction means for extracting reference frequency data of string vibration from pickup signals from said pickup devices, and pitch designation data generating means for acquiring said pitch designation data, and wherein said musical tone parameter setting means includes means for determining a fret operation position on the basis of said reference frequency data from said pitch extraction means and setting a specific musical tone parameter on the basis of said string data and said pitch designation data corresponding to said determined fret operation position.

3. The electronic stringed instrument according to claim 1, wherein said picking-data output means includes string trigger detecting means for detecting a beginning of said string vibration, to acquire said string trigger data, and fret position detecting means for detecting a fret operation position, to acquire said pitch designation data, and wherein said musical tone parameter setting means includes means for setting a specific musical tone parameter on the basis of said string trigger data from said string trigger detecting means and said pitch designation data from said fret position detecting means.

4. The electronic stringed instrument according to claim 3, wherein said string trigger detecting means comprises a conductive contact member coupled to each of said strings, a conductive flexible member provided around said conductive contact member, with a predetermined gap therebetween, and an insulative member for electrically insulating said conductive contact member and said conductive flexible member 5. The electronic stringed instrument according to claim 3, wherein said string trigger detecting means comprises string vibration pickup means provided for each of said strings, for outputting an associated electric signal upon vibration of said strings.

6. The electronic stringed instrument according to claim 3, wherein said fret position detecting means comprises a number of fret switches provided on a fingerboard at a neck protruding from a main body of said electronic stringed instrument.

7. The electronic stringed instrument according to claim 2, wherein said pitch extraction means includes:

peak detecting means for detecting, from said pickup devices, a positive peak or a negative peak of a waveform of an electric signal, representing string vibration;

zero cross point detecting means for detecting a zero cross point of said waveform; and fundamental frequency data extraction means for executing at least one of detection of a time interval ($t_1$) for each first zero cross point detected by said zero cross point detecting means after said positive peak is detected by said peak detecting means, detection of a time interval ($t_2$) for each first zero cross point detected by said zero cross point detecting means after said negative peak is detected by said peak detecting means, and detection of both of said time intervals ($t_1$) and ($t_2$), thereby extracting said fundamental frequency data of string vibration.

8. The electronic stringed instrument according to claim 1, further comprising parameter setting inhibition means for, when said picking-data output means detects that picking of at least two strings is performed with said at least one selection mode being set by said mode selecting means, inhibiting said musical tone parameter setting means from setting a specific musical tone parameter.

9. The electronic stringed instrument according to claim 1, further comprising parameter setting inhibition means for, when said picking-data output means detects that picking of said strings is performed in an open string operational status with said at least one selection mode being set by said mode selecting means, inhibiting said musical tone parameter setting means from setting a specific musical tone parameter.

10. The electronic stringed instrument according to claim 1, wherein said mode selecting means is musical tone parameter selecting means for selecting at least one of a timbre of a musical tone to be generated from said tone generating means and a rhythm pattern of a rhythm to be played in an automatic rhythm play, and wherein said musical tone parameter setting means sets said at least one of said timbre and said rhythm pattern selected by said musical tone parameter selecting means.

11. The electronic stringed instrument according to claim 1, further comprising:

tone on/off discriminating means for, when a specific musical tone parameter is set by said musical tone parameter setting means, discriminating whether or not a content of said set specific musical tone parameter is to be generated as a sound; and tone generation instructing means for, when generation of said content of said set specific musical tone parameter as a sound is discriminated by said ton on/off discriminating means, instructing said tone generating means to generate said content of said specific musical tone parameter as a sound.

* * * * *